US009507316B2

(12) United States Patent
Fujii et al.

(10) Patent No.: US 9,507,316 B2
(45) Date of Patent: Nov. 29, 2016

(54) IMAGE-FORMING DEVICE AND CARTRIDGE MOUNTABLE IN THE SAME

(71) Applicant: Brother Kogyo Kabushiki Kaisha, Nagoya-shi, Aichi-ken (JP)

(72) Inventors: Yasumasa Fujii, Chiryu (JP); Hiroki Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/672,748

(22) Filed: Mar. 30, 2015

(65) Prior Publication Data

US 2015/0205254 A1 Jul. 23, 2015

Related U.S. Application Data

(63) Continuation-in-part of application No. PCT/JP2012/081129, filed on Nov. 30, 2012.

(30) Foreign Application Priority Data

Nov. 20, 2012 (JP) ..... 2012-254791

(51) Int. Cl.
*G03G 21/16* (2006.01)
*G03G 21/18* (2006.01)

(52) U.S. Cl.
CPC ..... *G03G 21/1676* (2013.01); *G03G 21/1647* (2013.01); *G03G 21/1821* (2013.01)

(58) Field of Classification Search
CPC ..... G03G 21/1676; G03G 21/1647; G03G 21/181; G03G 21/1817; G03G 21/1821; G03G 21/1825; G03G 21/1842
See application file for complete search history.

(56) References Cited

U.S. PATENT DOCUMENTS

| | | | |
|---|---|---|---|
| 6,101,350 | A | 8/2000 | Suzuki et al. |
| 7,242,874 | B2 | 7/2007 | Tsusaka |
| 7,260,342 | B2 | 8/2007 | Nishimura |
| 7,298,990 | B2 | 11/2007 | Nishimura |
| 7,715,755 | B2 | 5/2010 | Shiraki |

(Continued)

FOREIGN PATENT DOCUMENTS

| | | | |
|---|---|---|---|
| JP | 2000-250310 | A | 9/2000 |
| JP | 2004-301944 | A | 10/2004 |

(Continued)

OTHER PUBLICATIONS

Jun 4, 2015—(PCT) International Preliminary Report on Patentablilty—App PCT/JP2012/081129.

(Continued)

*Primary Examiner* — Ericka J Villaluna
(74) *Attorney, Agent, or Firm* — Banner & Witcoff, Ltd.

(57) ABSTRACT

An image-forming device includes a cartridge and a main body including a cartridge receiving section configured to receive the cartridge. The cartridge includes a first cartridge configured to store developer therein, and a second cartridge configured to detachably accommodate the first cartridge. The first cartridge is attachable to the second cartridge in a state where the second cartridge alone is mounted in the cartridge receiving section, the first cartridge being configured to be restricted from getting detached from the second cartridge in a state where the first cartridge and the second cartridge are both mounted in the cartridge receiving section.

14 Claims, 19 Drawing Sheets

(56) References Cited

U.S. PATENT DOCUMENTS

| | | | |
|---|---|---|---|
| 8,761,634 | B2 | 6/2014 | Mori et al. |
| 2004/0190932 | A1 | 9/2004 | Ishii |
| 2005/0191090 | A1 | 9/2005 | Nishimura |
| 2005/0220461 | A1 | 10/2005 | Tsusaka |
| 2006/0133850 | A1 | 6/2006 | Nishimura |
| 2007/0217816 | A1 | 9/2007 | Shiraki |
| 2010/0303499 | A1 | 12/2010 | Mori et al. |

FOREIGN PATENT DOCUMENTS

| | | | |
|---|---|---|---|
| JP | 2005-242067 | A | 9/2005 |
| JP | 2005-292357 | A | 10/2005 |
| JP | 2006-106020 | A | 4/2006 |
| JP | 2006-268064 | A | 10/2006 |
| JP | 2007-011401 | A | 1/2007 |
| JP | 2007-256352 | A | 10/2007 |
| JP | 2008-129366 | A | 6/2008 |
| JP | 2009-169433 | A | 7/2009 |
| JP | 2010-276961 | A | 12/2010 |

OTHER PUBLICATIONS

Jul. 19, 2016—(JP) Office Action—App 2012-254791.

IMAGE-FORMING DEVICE AND CARTRIDGE MOUNTABLE IN THE SAME

CROSS REFERENCE TO RELATED APPLICATION

This application claims priority from Japanese Patent Application No. 2012-254791 filed Nov. 20, 2012. This application is also a continuation-in-part of International Application No. PCT/JP2012/081129 filed Nov. 30, 2012 in Japan Patent Office as a Receiving Office. The entire contents of both applications are incorporated herein by reference.

TECHNICAL FIELD

The present disclosure relates to an image forming apparatus which employs an electrophotographic system.

BACKGROUND

An image forming apparatus that employs an electrophotographic system well-known in the art includes a cartridge that stores developer.

As such an image forming apparatus, Japanese Patent Application Publication no. 2000-250310 discloses a printer that can detachably accommodate a process cartridge therein. The process cartridge includes a drum cartridge having a photosensitive drum, and a developing cartridge for storing toner that is detachably attachable to the drum cartridge.

SUMMARY

For shipment of this printer, in order to save space during transportation, one of possible packing methods is to mount the drum cartridge and developing cartridge in a main casing of the printer and then to pack the printer to reduce a package size of the printer.

As an example, the drum cartridge may be attached to the main casing, and the developing cartridge may be wrapped in a damp-proof and heat-shielding package and may be packaged together with the main casing, in order to suppress deterioration of toner inside the developing cartridge and to downsize the package.

However, in this case, when a user unpacks the package of the printer, only the developing cartridge is separated from the main casing.

In order for the user to mount the developing cartridge in the main casing after unpacking the printer, the user first needs to remove the drum cartridge from the main casing, attach the developing cartridge to the detached drum cartridge to assemble a process cartridge, and then mount the assembled process cartridge in the main casing.

User's mounting operation of the developing cartridge into the main casing therefore becomes complicated at the time of installation of the printer.

In order to solve this problem, it can be considered to configure such that only the developing cartridge is configured to be detached from the main casing, while the drum cartridge is provided in the main casing so as to be unable to be removed from the main casing.

However, if only the developing cartridge is made detachable from the main casing, the drum cartridge is kept mounted in the main casing, possibly resulting in insufficient maintenance on the drum cartridge.

In view of the foregoing, it is an object of the disclosure to provide an image forming apparatus with improved operability that allows reliable maintenance on both a first cartridge and a second cartridge, while realizing a compact package.

In order to attain the above and other objects, the disclosure provides an image-forming device that includes a cartridge and a main body. The cartridge includes a first cartridge configured to store developer therein, and a second cartridge configured to detachably accommodate the first cartridge. The main body includes a cartridge receiving section configured to receive the cartridge, the first cartridge being attachable to the second cartridge in a state where the second cartridge alone is mounted in the cartridge receiving section, the first cartridge being configured to be restricted from getting detached from the second cartridge in a state where the first cartridge and the second cartridge are both mounted in the cartridge receiving section.

DETAILED DESCRIPTION

1. Overall Structure of the Printer

Figure 1:
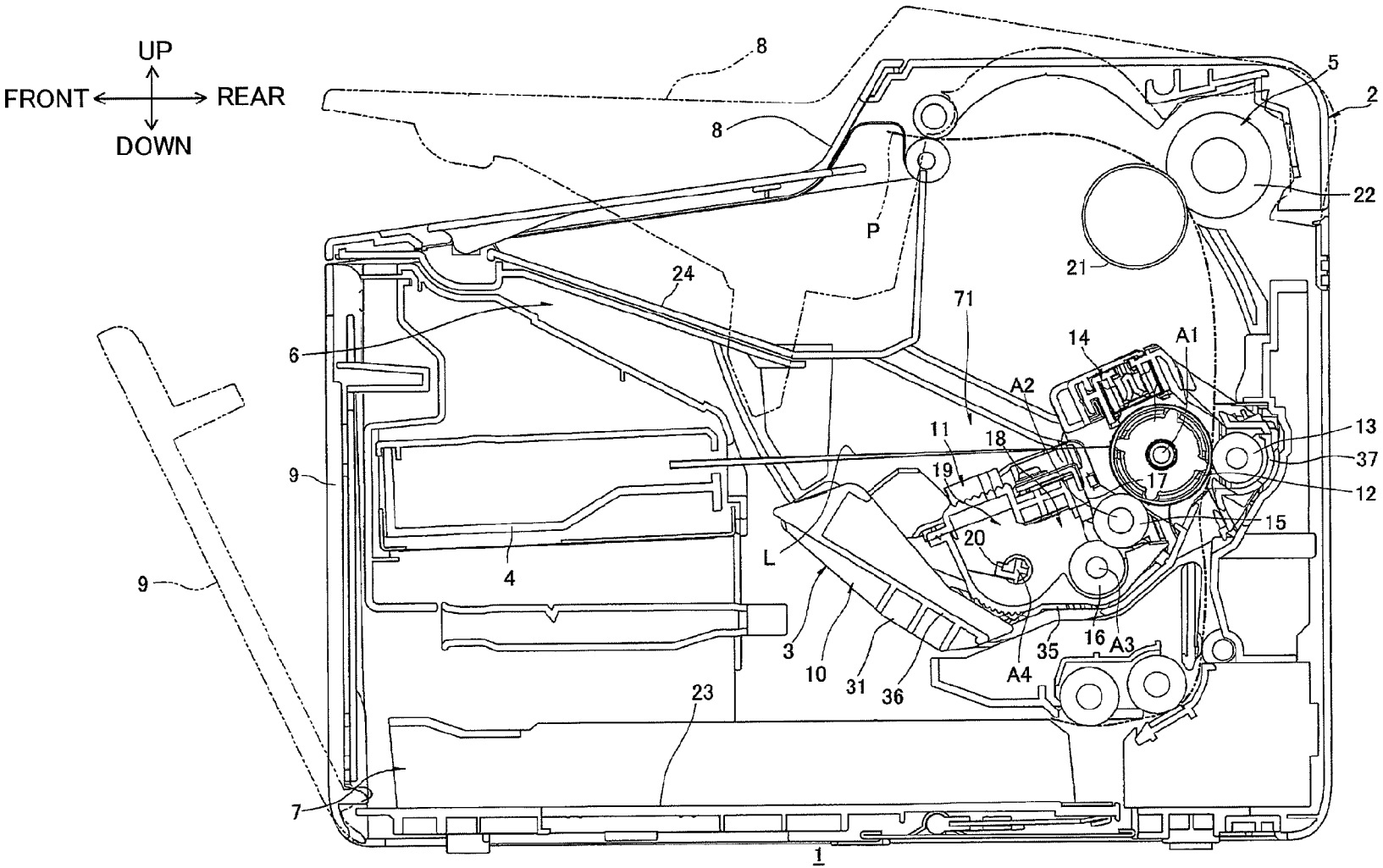
FIG. 1 is a central cross-sectional view of a printer as an image forming apparatus according to an embodiment, the printer accommodating a process cartridge therein.

FIG. 1 shows a printer 1 serving as an example of an image-forming device according to an embodiment.

Directions related to the printer 1 will be specified based on an orientation in which the printer 1 is resting on a level surface. Specifically, the upper side in FIG. 1 will be referred as an upper side of the printer 1, while the lower side in FIG. 1 will be referred to as a lower side of the printer 1. The left side and right side in FIG. 1 will be referred to as a front side and a rear side of the printer 1, respectively. Left and right sides of the printer 1 will be based on a perspective of a user facing the front side of the printer 1. That is, the near side in FIG. 1 is called as right side of the printer 1, and the far side in FIG. 1 is called as a left side of the printer 1. These directions are shown specifically in each drawing.

The printer 1 includes a main casing 2 as an example of a main body. Within the main casing 2, the printer 1 is also provided with a process cartridge 3 as an example of a cartridge, a scanner unit 4 and a fixing unit 5.

The main casing 2 is formed in an approximately box shape. The main casing 2 is formed with a cartridge opening 6 as an example of a device opening and a sheet opening 7. The main casing 2 is provided with a top cover 8 for opening and closing the cartridge opening 6, and a sheet-feeding cover 9 for opening and closing the sheet opening 7.

The cartridge opening 6 is formed in an upper end portion of the main casing 2 and penetrates the same in an up-down direction. The cartridge opening 6 serves to permit detachment and attachment of the process cartridge 3 therethrough.

The top cover 8 is provided in the upper end portion of the main casing 2 and is capable of pivoting about a rear end thereof (see phantom lines in FIG. 1).

The sheet opening 7 is formed in a lower-front end portion of the main casing 2 to penetrate the same in a front-rear direction.

The sheet-feeding cover 9 is provided in a front end portion of the main casing 2 and is capable of pivoting about a lower end thereof (see phantom lines in FIG. 1). When the sheet-feeding cover 9 is opened, the sheet placing portion 23 is defined in a bottom end portion of the main casing 2 through the sheet opening 7. The sheet opening 7 thus serves to receive sheets of paper P on the sheet placing portion 23.

The process cartridge 3 is configured to be accommodated in an approximate vertical center portion of the main casing 2 and is configured to be detachably attached to the main casing 2. The process cartridge 3 includes a drum cartridge 10 as an example of a second cartridge, and a developing cartridge 11 detachably attachable to the drum cartridge 10 as an example of a first cartridge.

The drum cartridge 10 includes a photosensitive drum 12 as an example of a photosensitive body, a transfer roller 13, and a scorotron charger 14 as an example of a charger.

The photosensitive drum 12 is formed in a generally cylindrical shape extending in a left-right direction as an example of a longitudinal direction. The photosensitive drum 12 is rotatably provided in a rear-end portion of the drum cartridge 10.

The transfer roller 13 is rotatably provided in the rear-end portion of the drum cartridge 10 at a position rearward of the photosensitive drum 12. The transfer roller 13 is in pressure-contact with the photosensitive drum 12 from a rear side thereof.

The scorotron charger 14 is disposed above the photosensitive drum 12 and faces the photosensitive drum 12 with a prescribed distance defined therebetween.

The developing cartridge 11 includes a developing roller 15 as an example of a developer carrier, a supply roller 16, and a thickness regulating blade 17.

The developing roller 15 is rotatably provided in a rear end portion of the developing cartridge 11. The developing roller 15 is in contact with a lower-front end portion of the photosensitive drum 12.

The supply roller 16 is rotatably provided at a position downward and frontward of the developing roller 15. The supply roller 16 is in contact with a lower-front end portion of the developing roller 15.

The thickness regulating blade 17 is disposed upward and frontward of the developing roller 15. The thickness regulating blade 17 is in contact with the developing roller 15 from its front side.

In the developing cartridge 11, a rear-side half thereof serves as a developing chamber 18 for supporting the developing roller 15, the supply roller 16, and the thickness regulating blade 17, while a front-side half thereof serves as a toner chamber 19 for storing toner as an example of developer. The developing chamber 18 and the toner chamber 19 are in communication with each other. Within the toner chamber 19, an agitator 20 is provided for conveying toner to the developing chamber 18.

The scanner unit 4 is disposed in an approximate vertical center portion of the main casing 2 at a position frontward of the process cartridge 3. The scanner unit 4 is configured to emit a laser beam L based on image data toward the photosensitive drum 12 to expose a peripheral surface of the photosensitive drum 12. The trajectory of the laser beam L is shown in FIG. 1.

The fixing unit 5 is disposed in an upper-rear end portion of the main casing 2 at a position upward of the process cartridge 3. The fixing unit 5 includes a heating roller 21 and a pressure roller 22 that is in contact with the heating roller 21 on an upper rear side thereof with pressure.

When a print job is inputted to the printer 1 and an image forming operation is initiated, the toner in the toner chamber 19 is tribo-charged with a positive polarity in accordance with rotation of the supply roller 16 and the developing roller 15, is regulated into a uniform thickness by the thickness regulating blade 17, and is carried on a surface of the developing roller 15 as a thin layer of a uniform thickness.

In the meantime, the peripheral surface of the photosensitive drum 12 is uniformly charged by the scorotron charger 14, and is then exposed by the laser beam L from the scanner unit 4. As a result, an electrostatic latent image based on image data is formed on the peripheral surface of the photosensitive drum 12. The toner carried on the surface of the developing roller 15 is supplied to the electrostatic latent image on the peripheral surface of the photosensitive drum 12, thereby forming a toner image on the peripheral surface of the photosensitive drum 12.

Due to rotation of various rollers, the sheets P stacked on the sheet placing portion 23 are configured to be supplied one by one between the photosensitive drum 12 and the transfer roller 13 at predetermined time intervals. The toner image carried on the peripheral surface of the photosensitive drum 12 is transferred to the sheet P to form an image thereon while the sheet P passes between the photosensitive drum 12 and the transfer roller 13.

Subsequently, the sheet P is applied with heat and pressure when passing between the heating roller 21 and the pressure roller 22, whereby the image is thermally fixed to the sheet P. The sheet P is then discharged to a sheet discharge tray 24 formed in the top cover 8.

In this way, during the image forming operation of the printer 1, the sheet P is configured to be conveyed from the sheet placing portion 23 to the sheet discharge tray 24 along a generally C-shaped path in a side view.

2. Structure of the Process Cartridge

As described above and illustrated in FIGS. 2 and 3, the process cartridge 3 includes the drum cartridge 10 and the developing cartridge 11.

In the following description of the process cartridge 3, directions related to the process cartridge 3 will be given under an assumption that the side of the process cartridge 3 on which the photosensitive drum 12 is disposed is defined as the rear side, and the side of the process cartridge 3 on which the scorotron charger 14 is disposed is defined as the upper side. That is, the up-down and front-rear directions related to the process cartridge 3 are slightly different from those related to the printer 1. Specifically, when the process cartridge 3 is mounted on the main casing 2 of the printer 1, the rear side of the process cartridge 3 faces the upper-rear side of the printer 1 and the front side of the process cartridge 3 faces the lower-front side of the printer 1.

(1) Drum Cartridge

Figure 2:
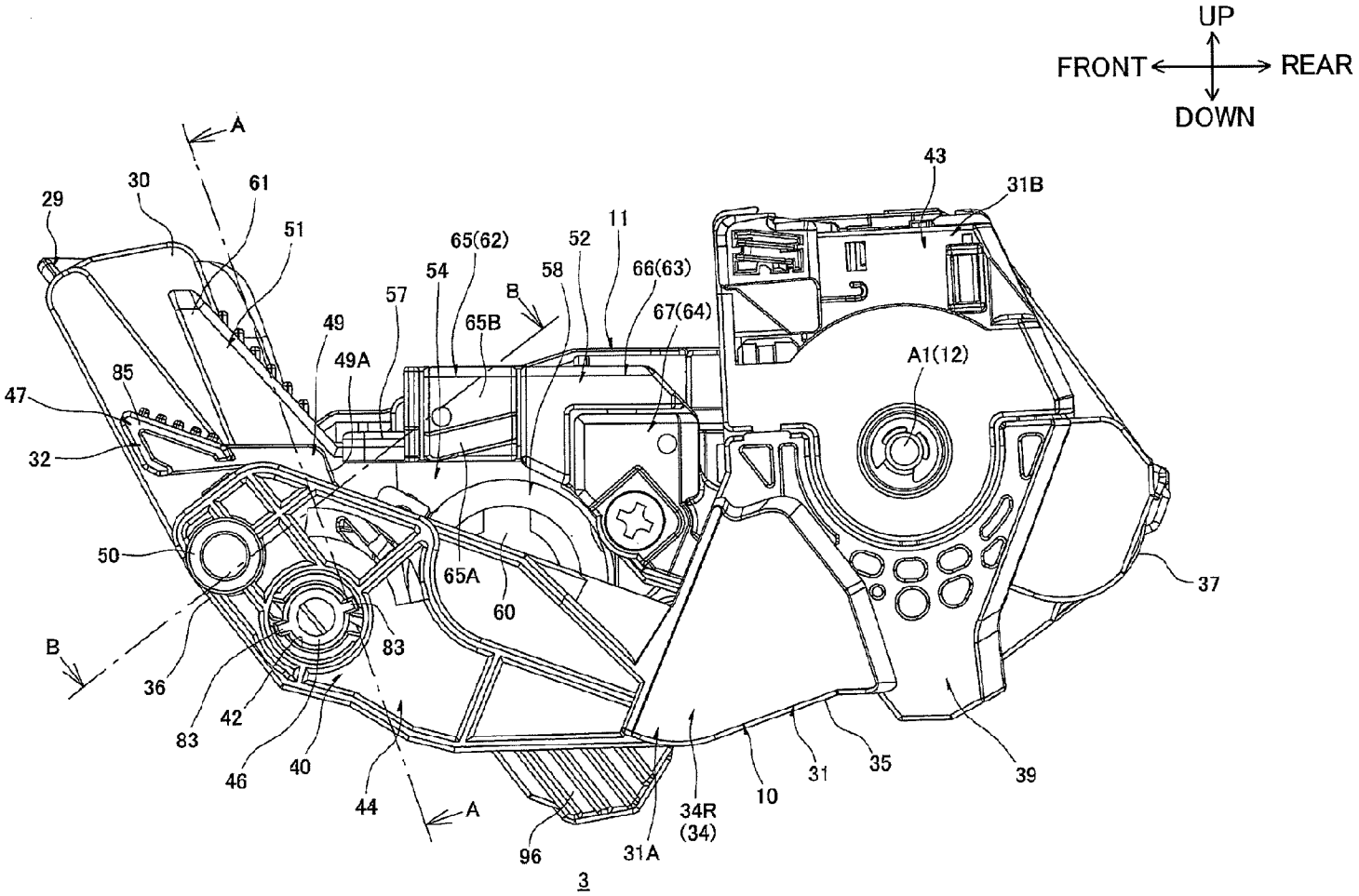
FIG. 2 is a right side view of the process cartridge according to the embodiment shown in FIG. 1.
Figure 3:
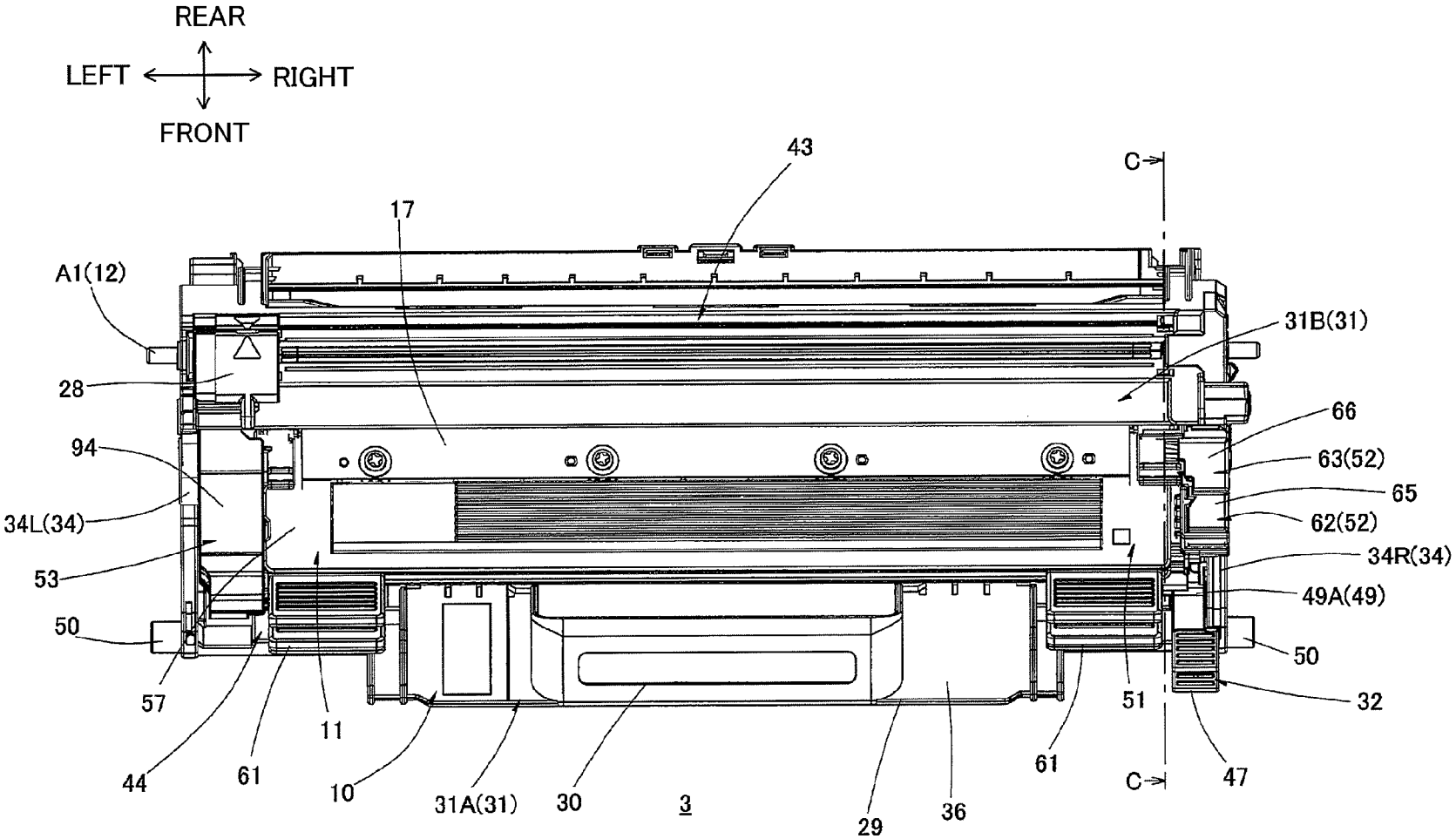
FIG. 3 is a plan view of the process cartridge according to the embodiment shown in FIG. 1.
Figure 5:
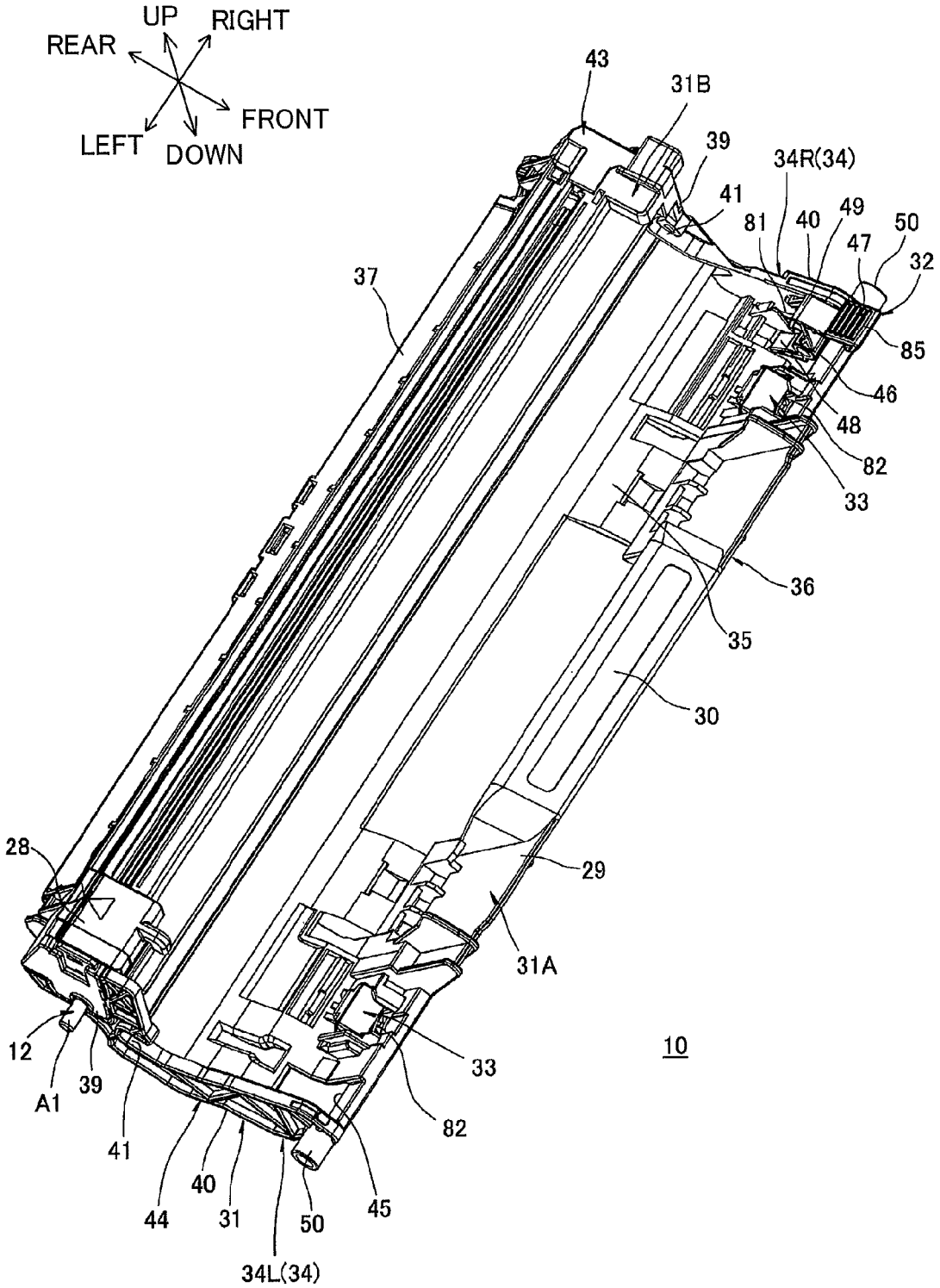
FIG. 5 is a perspective view of a drum cartridge constituting the process cartridge according to the embodiment shown in FIG. 2 as viewed from an upper-left side thereof.

As illustrated in FIGS. 2 and 5, the drum cartridge 10 includes a drum frame 31, a lock lever 32 as an example of a restricting member, and a pair of pressing members 33.

The drum frame 31 includes a base frame 31A as an example of a first frame and a cover frame 31B as an example of a second frame.

The base frame 31A is colored in green or blue, for example, (specifically, in green in the embodiment). The base frame 31A is formed in a generally frame-like shape with a closed bottom and has a generally rectangular shape in a plan view. The base frame 31A includes a pair of left and right side walls 34, a lower wall 35, a front wall 36, and a rear wall 37.

The pair of side walls 34 is disposed to face each other in the left-right direction with a gap defined therebetween. The side wall 34 has an approximately flat plate-like shape extending in the front-rear direction and in the up-down direction.

In the following description, the side wall on the right is referred to as a right wall 34R and the side wall on the left is referred to as a left wall 34L, whenever necessary. Each side wall 34 integrally includes a rearward portion 39 and a frontward portion 40. The rearward portion 39 constitutes a rear half thereof and the frontward portion 40 constitutes a front-half thereof.

The rearward portion 39 has a generally rectangular shape in a side view that extends in the up-down direction. A guide groove 41 is formed in the rearward portion 39 of each side wall 34.

Specifically, referring to FIG. 5, the guide groove 41 of the right wall 34R is a groove that is recessed rightward from an inner surface (left surface) of the rearward portion 39 on a lower end portion thereof. The guide groove 41 of the right wall 34R extends from a front edge of the rearward portion 39 toward rearward and downward, and then bends rearward. The guide groove 41 of the right wall 34R has a lower surface that is formed to be continuous to an upper surface of the rearward portion 39. The guide groove 41 of the right wall 34R is configured to receive a right end of a developing roller shaft A2 described later.

The guide groove 41 of the left wall 34L is formed in a lower end portion of the rearward portion 39. The guide groove 41 of the left wall 34L has an approximately U-shape in a side view whose opening of the "U" faces frontward. The guide groove 41 of the left wall 34L is notched rearward from a front edge of the lower end portion of the rearward portion 39. The guide groove 41 of the left wall 34L has a lower surface that is formed to be continuous to an upper surface of the rearward portion 39. The guide groove 41 of the left wall 34L is configured to receive a left end of the developing roller shaft A2 described later.

The frontward portion 40 is formed in a generally rectangular shape in a side view and extends continuously frontward from the lower end portion of the corresponding rearward portion 39. Each frontward portion 40 includes a guide boss 50. Further, the frontward portion 40 of the right wall 34R is formed with a lock lever support hole 42.

The lock lever support hole 42 is formed in a front end portion of the frontward portion 40 of the right wall 34R to penetrate therethrough. The lock lever support hole 42 has an approximately circular shape in a side view. The lock lever support hole 42 has a diameter slightly larger than an outer diameter of a pivot shaft 46 (described later) of the lock lever 32.

The guide boss 50 is provided in the front end portion of each frontward portion 40. In the right wall 34R, the guide boss 50 is positioned upward and frontward of the lock lever support hole 42. The guide boss 50 is formed in a generally columnar shape and protrudes outward from an outer surface of the corresponding side wall 34 in the left-right direction.

The lower wall 35 is arranged to span between the lower end portions of the pair of side walls 34. The lower wall 35 has a generally flat plate-like shape extending in the front-rear direction. A pair of restricting ribs 96 is formed on the lower wall 35.

Each restricting rib 96 is formed on each of left and right ends of the lower wall 35 on a rear end portion thereof. Each restricting rib 96 has an approximately rectangular shape in a side view and protrudes downward from a lower surface of the rear end portion of the lower wall 35.

Figure 4B:
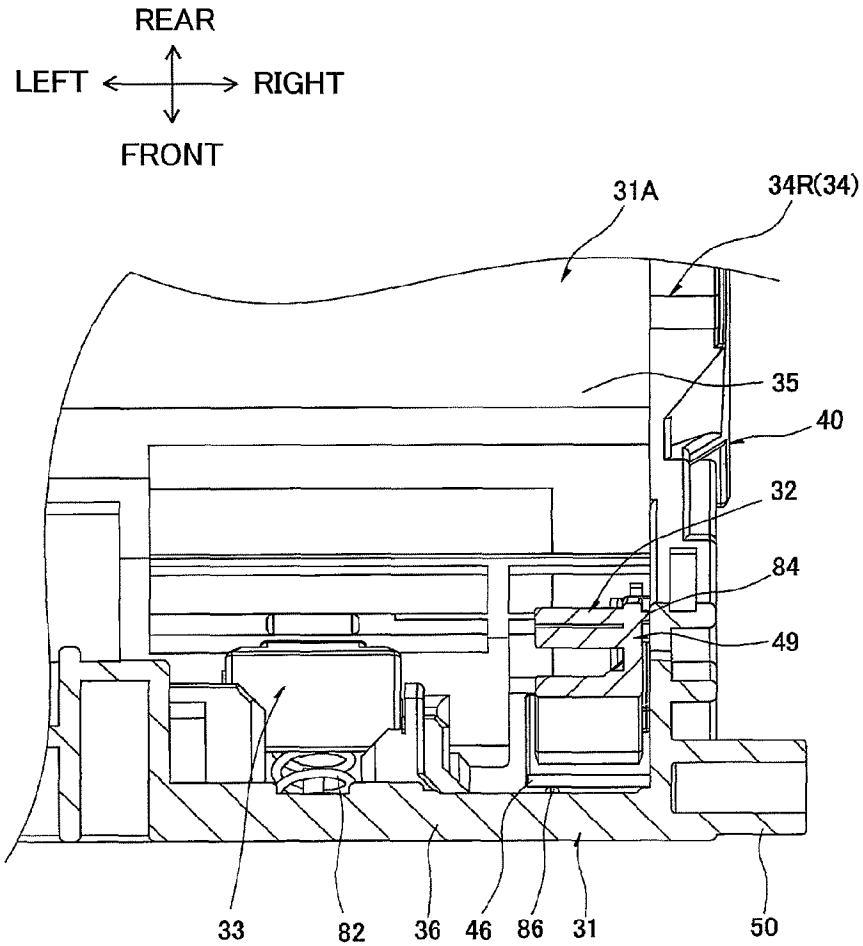
FIG. 4B is a cross-sectional view of an essential portion of the process cartridge according to the embodiment taken along a B-B plane shown in FIG. 2.
Figure 4A:
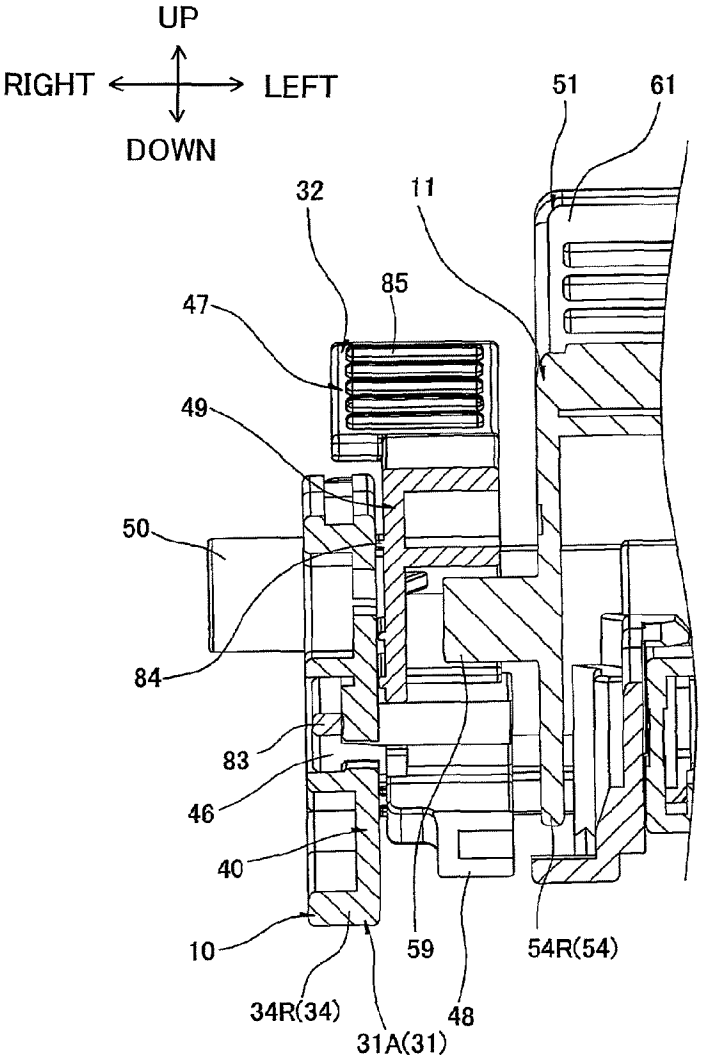
FIG. 4A is a cross-sectional view of an essential portion of the process cartridge according to the embodiment taken along an A-A plane shown in FIG. 2.

As illustrated in FIGS. 4A, 4B, and 5, the front wall 36 extends upward continuously from a front end of the lower wall 35. The front wall 36 has a generally flat plate-like shape in a front view and is arranged to span between front ends of the pair of side walls 34. The front wall 36 includes an extension part 29, a drum-cartridge grip 30 as an example of a second grip, and a supporting rib 86.

The extension part 29 protrudes upward from an upper end portion of the front wall 36 at a generally center thereof in the left-right direction. The extension part 29 has a generally flat plate-like shape extending in the left-right direction.

The drum-cartridge grip 30 is formed on the extension part 29 to protrude rearward from a rear surface of the extension part 29 at a position generally center thereof in the left-right direction. The drum-cartridge grip 30 has a generally rectangular cylindrical shape elongated in the left-right direction.

The supporting rib 86 is formed on a right end portion of the front wall 36. The supporting rib 86 is a rib protruding rearward from a rear surface of the rear end portion of the front wall 36 and extends in the up-down direction. The supporting rib 86 is configured to abut on a left end of the pivot shaft 46 of the lock lever 32 (described later) from a lower-front side thereof. The supporting rib 86 is configured to restrict the left end of the lock lever 32 from getting inclined downward and frontward.

As illustrated in FIGS. 1 and 5, the rear wall 37 is arranged to span between the rear end portions of the pair of side walls 34. The rear wall 37 is formed in a flat-plate shape having a generally U-shape that is open frontward in a cross-sectional view. The transfer roller 13 is rotatably supported frontward of the rear wall 37.

The cover frame 31B is assembled to a rear end portion of the base frame 31A from above such that a cartridge attachment portion 44 (described later) is exposed. The cover frame 31B is colored in a color (for example, in black) that is different from that of the base frame 31A. The cover frame 31B is formed in an approximately rectangular cylindrical shape that extends in the left-right direction and that is open downward and frontward. The scorotron charger 14 and a wire cleaner 28 for cleaning a wire of the scorotron charger 14 are supported on the cover frame 31B. The wire cleaner 28 is colored in green, for example.

In the drum cartridge 10, a drum accommodating section 43 for accommodating the photosensitive drum 12 is defined. Specifically, the drum accommodating section 43 is defined by: the cover frame 31B; the rear-side half of the lower wall 35 of the base frame 31A; the rear wall 37; the rearward portion 39 of the right wall 34R; and the rearward portion 39 of the left wall 34L.

The photosensitive drum 12 includes a drum shaft A1 whose right end is rotatably supported by the rearward portion 39 of the right wall 34R, and whose left end is rotatably supported by the rearward portion 39 of the left wall 34L.

The right end of the drum shaft A1 penetrates through the right wall 34R of the cover frame 31B and protrudes rightward therefrom. The left end of the drum shaft A1 penetrates through the left wall 34L of the cover frame 31B and protrudes leftward therefrom.

In the drum cartridge 10, the cartridge attachment portion 44 is also defined for receiving the developing cartridge 11 as an example of a first-cartridge attachment portion. Specifically, the cartridge attachment portion 44 is defined by: the front-side half of the lower wall 35; the front wall 36; the frontward portion 40 of the right wall 34R; and the frontward portion 40 of the left wall 34L. A detection-gear exposure opening 45 is formed in the cartridge attachment portion 44.

As shown in FIG. 5, the detection gear exposure opening 45 is formed in a left end portion of the drum frame 31 on a lower-front end thereof. The detection gear exposure opening 45 spans across a front end of the lower wall 35 and a lower end of the front wall 36. The detection gear exposure opening 45 is formed as a through-hole having an approximately rectangular shape in a plan view and extending in the front-rear direction.

As illustrated in FIGS. 4A, 4B, and 5, the lock lever 32 is provided leftward of a front end portion of the right wall 34R. The lock lever 32 is formed of a resiliently deformable material such as a resin and is colored in blue, for example. The lock lever 32 integrally includes the pivot shaft 46 as an example of a pivot fulcrum, an operation portion 47 extending upward from the pivot shaft 46, and a lift portion 48 extending downward and rearward from the pivot shaft 46.

The pivot shaft 46 is formed in an approximately columnar shape extending in the left-right direction. The pivot shaft 46 includes a pair of engagement projections 83.

Referring to FIGS. 2 and 4A, the engagement projections 83 are formed in an approximately rectangular columnar shape and protrude radially outward from an outer surface of a right end of the pivot shaft 46. On a peripheral portion of the lock lever support hole 42, the engagement projections 83 are in abutment with the right surface of the right wall 34R from a right side thereof. The engagement projections 83 are configured to restrict the lock lever 32 from moving leftward.

The operation portion 47 has a generally bent rail-like shape. Specifically, referring to FIGS. 8A to 8B, the operation portion 47 first extends upward from an upper end portion of the pivot shaft 46 to have an upper end that is positioned higher than the upper edge of the right wall 34R, and then bends frontward from the upper end. The operation portion 47 includes a restricting part 49 and an abutting part 85 (as an example of an abutting part).

Figure 8A:
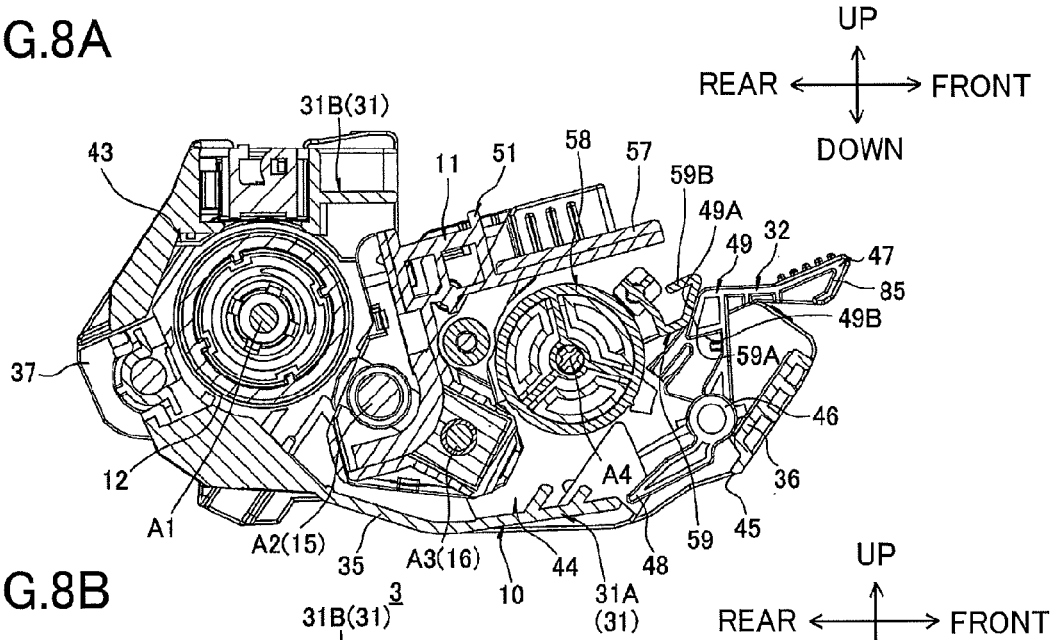
FIG. 8A is an explanatory view taken along a C-C plane shown in FIG. 3, illustrating how the developing cartridge is attached to the drum cartridge, in which a restricted part of the developing cartridge is in abutment with a restricting part of a lock member of the drum cartridge from above.
Figure 8B:
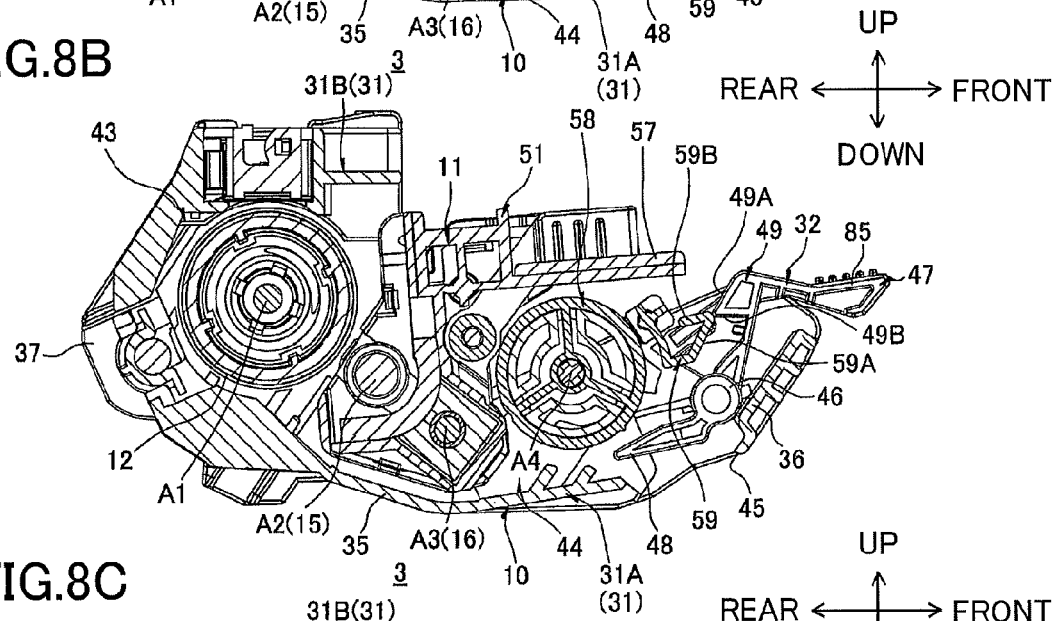
FIG. 8B is an explanatory cross-sectional view taken along the C-C plane shown in FIG. 3, illustrating how the developing cartridge is attached to the drum cartridge after the state of FIG. 8A, in which the lock member is pivotally moved from a lock position to a temporarily-locked position due to pressing of the restricted part of the developing cartridge.
Figure 8C:
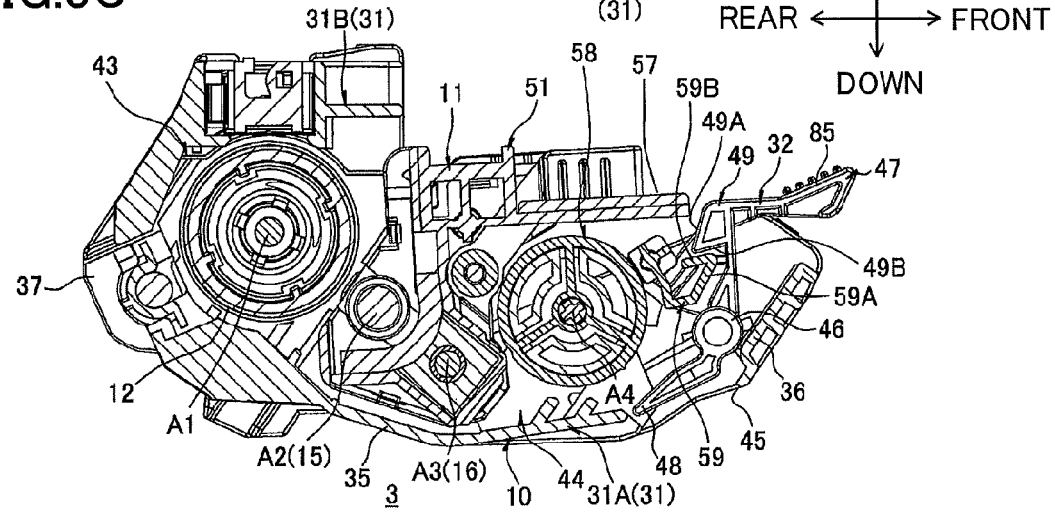
FIG. 8C is an explanatory cross-sectional view taken along the C-C plane shown in FIG. 3, illustrating how the developing cartridge is attached to the drum cartridge after the state of FIG. 8B, in which the restricting part of the lock member faces the restricted part of the developing cartridge from above.

The restricting part 49 protrudes downward and rearward from the upper end of the operation portion 47. The restricting part 49 has a generally wedge-like shape whose apex faces downward and rearward in a side view. The restricting part 49 has a left end portion that advances into an attachment/detachment trajectory of the developing cartridge 11 relative to the drum cartridge 10. As illustrated in FIGS. 8A to 8C, the restricting part 49 includes a sliding surface 49A as an example of a first surface, a restricting surface 49B as an example of a second surface, and an abutting rib 84.

The sliding surface 49A constitutes an upper-rear surface of the restricting part 49. When the lock lever 32 is in a locking position described later (a state shown in FIG. 8C), the sliding surface 49A slopes slightly upward toward the front.

The restricting surface 49B constitutes a lower-front surface of the restricting part 49. When the lock lever 32 is in the locking position shown in FIG. 8C, the restricting surface 49B slopes upward toward the front.

As illustrated in FIGS. 4A and 4B, the abutting rib 84 is a projection that slightly protrudes rightward from a right surface of the restricting part 49. The abutting rib 84 is in abutment with the left surface of the right wall 34R from the left side. The abutting rib 84 and the engagement projection 83 of the pivot shaft 46 sandwich the right wall 34R therebetween, thereby restricting movement of the lock lever 32 with respect to the left-right direction. The lock lever 32 at the locking position can restrict the front end portion of the developing cartridge 11 from moving upward.

The abutting part 85 is positioned on a front end of the operation portion 47 such that the abutting part 85 is positioned farther away from the pivot shaft 46 than the sliding surface 49A is from the pivot shaft 46. The abutting part 85 is formed in an approximately wedge-like shape whose apex faces upward and frontward in a side view.

The lift portion 48 extends downward and reward from a lower end of the pivot shaft 46 and has an approximately rail-like shape in a side view.

With the right end of the pivot shaft 46 pivotally movably inserted in the lock lever support hole 42 of the right wall 34R, the lock lever 32 is supported by the right wall 34R so as to be pivotable between the locking position (as an example of a restricting position) illustrated in FIG. 8C and an unlocking position (as an example of a non-restricting position (not illustrated) at which the lock lever 32 is pivoted clockwise from the locking position in a left side view). When the lock lever 32 is at the locking position, the operation portion 47 is in a lifted posture. When the lock lever 32 is at the unlocking position, the operation portion 47 is in a tilted posture.

Figure 17A:
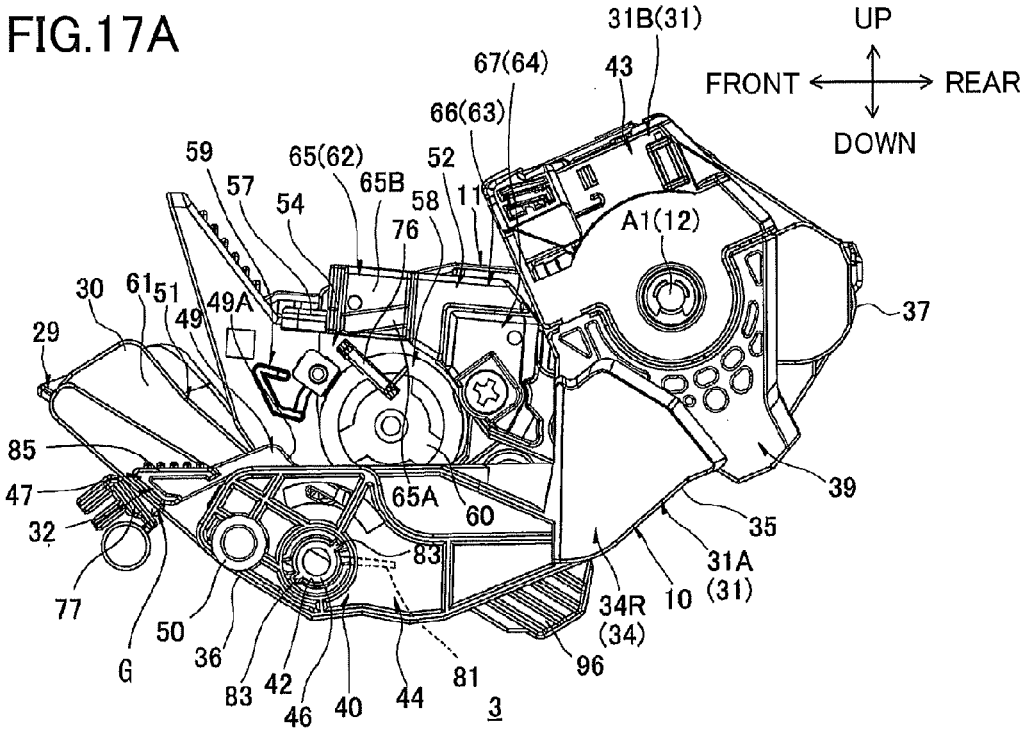
FIG. 17A is an explanatory view illustrating attachment of the developing cartridge to the drum cartridge mounted on the main casing, in which the supply electrode is about to make contact with the body-side supply electrode.
Figure 17B:
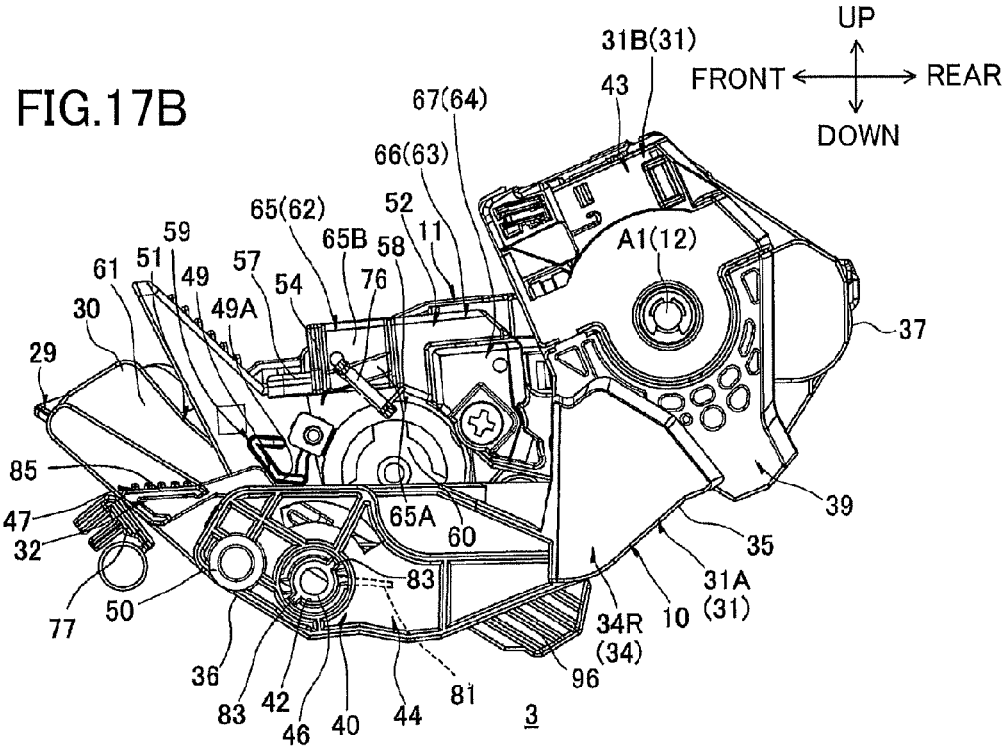
FIG. 17B is an explanatory view illustrating attachment of the developing cartridge to the drum cartridge mounted on the main casing after the state of FIG. 17A, in which the guide surface of the supply electrode is contacted by the body-side supply electrode, the body-side developing electrode being omitted in FIGS. 17A and 17B.

The lock lever 32 is biased counterclockwise in a left side view by a wire spring 81 that extends frontward from the right end of the pivot shaft 46 (see FIGS. 5, 17A and 17B). The lock lever 32 is thus biased to be normally at the locking position.

As illustrated in FIGS. 4B and 5, the two pressing members 33 are supported one on each end portion of the front wall 36 in the left-right direction. The pressing members 33 are formed in an approximately rectangular cylindrical shape whose rear end is closed. Each pressing member 33 is normally biased rearward by a compression spring 82 that is supported within the pressing member 33.

(2) Developing Cartridge

Figure 6:
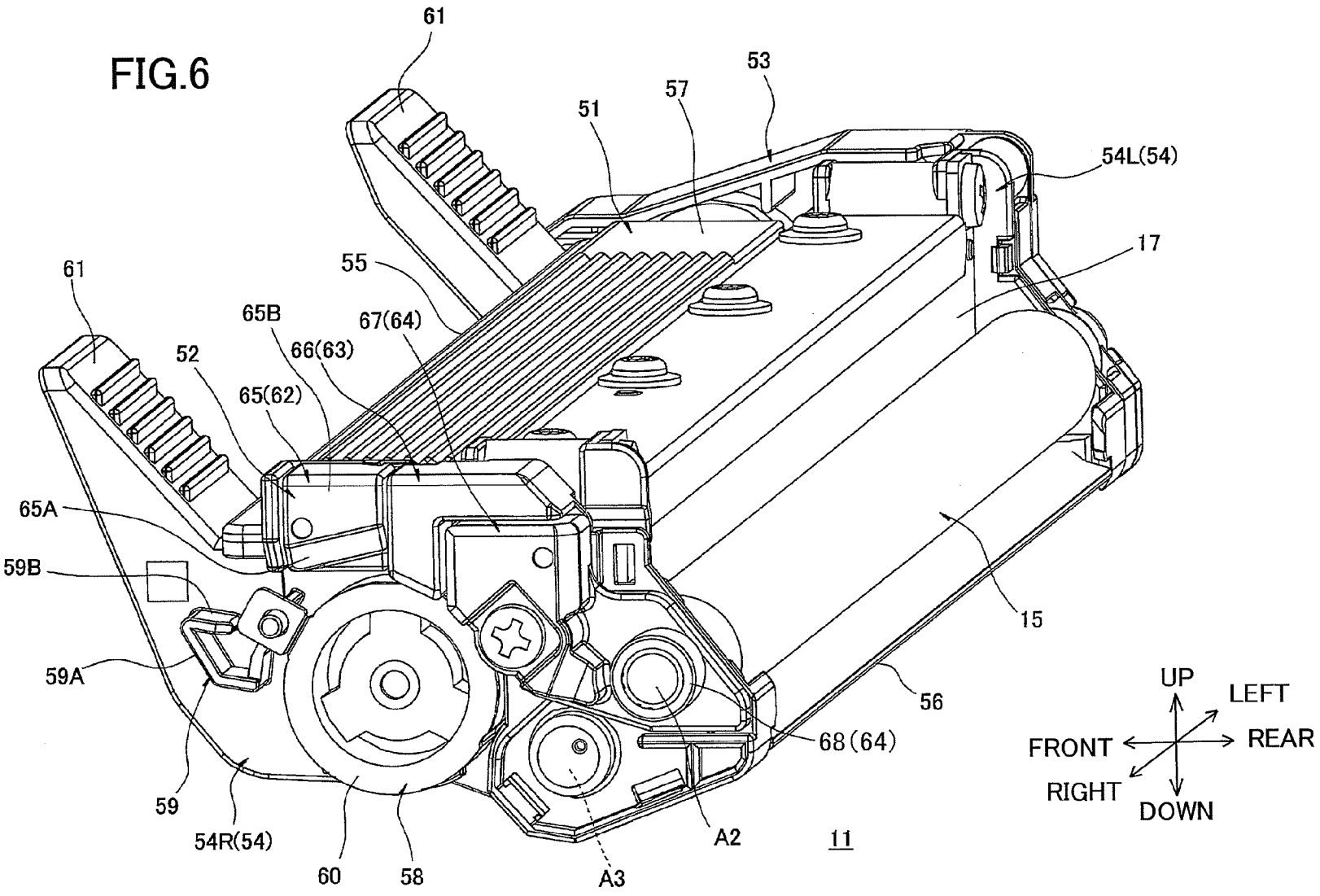
FIG. 6 is a perspective view of a developing cartridge constituting the process cartridge according to the embodiment shown in FIG. 2 as viewed from an upper-right side thereof.

As illustrated in FIG. 6, the developing cartridge 11 includes a developing frame 51, a power-supply unit 52 provided on a right end portion of the developing frame 51, and a drive unit 53 provided on a left end portion of the developing frame 51.

(2-1) Developing Frame

The developing frame 51 is formed in a generally box-like shape elongated in the left-right direction. Specifically, the developing frame 51 includes a pair of left and right side walls 54, a front wall 55, a lower wall 56, and an upper wall 57. In the following description, when referring to left and right sides of the side walls 54, the left side wall 54 will be referred to as a left wall 54L and the right side wall 54 will be referred to as a right wall 54R, whenever necessary.

The pair of side walls 54 is disposed in opposition to each other and spaced away from each other in the left-right direction. The side walls 54 are formed in an approximately rectangular shape in a side view and extend in the up-down direction and in front-rear direction. The developing roller 15 is supported between the pair of side walls 54.

The developing roller 15 includes a metallic rotation shaft A2 extending in the left-right direction. In the following description, the rotation shaft A2 of the developing roller 15 is referred to as the developing roller shaft A2. The developing roller shaft A2 has both ends penetrating the respective side walls 54 and protruding outward therefrom.

The right wall 54R includes a filling part 58 and a restricted part 59.

The filling part 58 is provided on a front-rear center portion of the right wall 54R so as to penetrate therethrough. The filling part 58 is formed in a generally cylindrical shape extending rightward from the right surface of the right wall 54R. A resin cap 60 is fitted to a right end of the filling part 58.

The restricted part 59 is disposed frontward of the filling part 58. The restricted part 59 is formed as a rib that protrudes rightward from the right surface of the right wall 54R. The restricted part 59 has a bent front end portion to provide an approximately wedge-like shape in a side view. The restricted part 59 includes a sliding surface 59A as an example of a third surface and a restricted surface 59B as an example of a fourth surface.

The sliding surface 59A constitutes a lower-front surface of the restricted part 59. The sliding surface 59A slopes rearward as extending toward the bottom.

The restricted surface 59B constitutes an upper surface of the restricted part 59. The restricted surface 59B extends in the front-rear direction.

As illustrated in FIGS. 1 and 6, the lower wall 56 is formed in an approximately flat plate-like shape extending in the front-rear direction.

The front wall 55 is formed in a generally flat plate-like shape and extends upward and continuously from a front end of the lower wall 56. On the front wall 55, two developing-cartridge grips 61 are formed as an example of a first grip.

The two developing-cartridge grips 61 are provided one on each of left and right end portions of the front wall 55. The developing-cartridge grips 61 are formed in an approximately flat plate-like shape in a top view and extend diagonally upward and frontward and continuously from an upper end of the front wall 55.

The upper wall 57 is formed in a generally flat plate-like shape and extends in the front-rear and left-right directions. The upper wall 57 has a peripheral portion that is fixed to the both side walls 54 and the upper end of the front wall 55, for example, by means of welding.

(2-2) Power-Supply Unit

As illustrated in FIG. 6, the power-supply unit 52 includes a supply electrode 62, a bearing member 63, and a developing electrode 64.

The supply electrode 62 is formed of an electrically conductive resin material and is supported on the right wall 34R of the developing frame 51 with some backlash. The supply electrode 62 includes a supply-side contact 65 configured to be electrically connected to a body-side supply electrode 76 (described later) provided in the main casing 2. The supply electrode 62 is electrically connected to a rotation shaft A3 of the supply roller 16. Hereinafter, the rotation shaft A3 of the supply roller 16 is referred to as a supply roller shaft A3.

The supply-side contact 65 is disposed upward of the filling part 58. The supply-side contact 65 is formed in a rectangular cylindrical shape whose right end is closed and has a generally rectangular shape in a side view. The supply-side contact 65 has a right surface on which a guiding surface 65A and a contact surface 65B are defined.

The guiding surface 65A constitutes a lower half of the right surface of the supply-side contact 65. The guiding surface 65A is sloped leftward toward the bottom.

The contact surface 65B constitutes an upper half of the right surface of the supply-side contact 65 and extends continuously from an upper end of the guiding surface 65A. The contact surface 65B extends in in the up-down direction.

The bearing member 63 is formed of an electrically insulating resin material. The bearing member 63 is fixed to the right wall 54R of the developing frame 51 and is positioned rightward of the supply electrode 62. The bearing member 63 rotatably supports the supply roller shaft A3 and the developing roller shaft A2.

The bearing member 63 includes an insulating part 66 configured to electrically insulate the supply-side contact 65 from a developing-side contact 67 described later. The insulating part 66 is disposed downward and rearward of the supply-side contact 65. The insulating part 66 is formed in a rectangular cylindrical shape with a closed right end and extending in the left-right direction. The insulating part 66 has a generally L-shape in a side view.

The developing electrode 64 is formed of an electrically conductive resin material. The developing electrode 64 is supported on the bearing member 63 with some backlash and is positioned rightward of the insulating part 66 of the bearing member 63. The developing electrode 64 includes the developing-side contact 67 configured to be electrically connected to a body-side developing electrode 75 provided in the main casing 2. The developing electrode 64 also includes a developing-roller-shaft covering part 68 that covers the right end of the developing roller shaft A2.

The developing-side contact 67 is disposed rearward and downward of the insulating part 66 of the bearing member 63. The developing-side contact 67 is formed in a rectangular cylindrical shape with a closed right end extending in the left-right direction. The developing-side contact 67 has an approximately rectangular shape in a side view.

The developing-roller-shaft covering part 68 is disposed downward and rearward of the developing-side contact 67. The developing-roller-shaft covering part 68 has a generally cylindrical shape extending in the left-right direction. The developing-roller-shaft covering part 68 has an inner diameter that is slightly larger than an outer diameter of the developing roller shaft A2. The right end of the developing roller shaft A2 is rotatably fitted into the developing-roller-shaft covering part 68.

(2-3) Drive Unit

Figure 14:
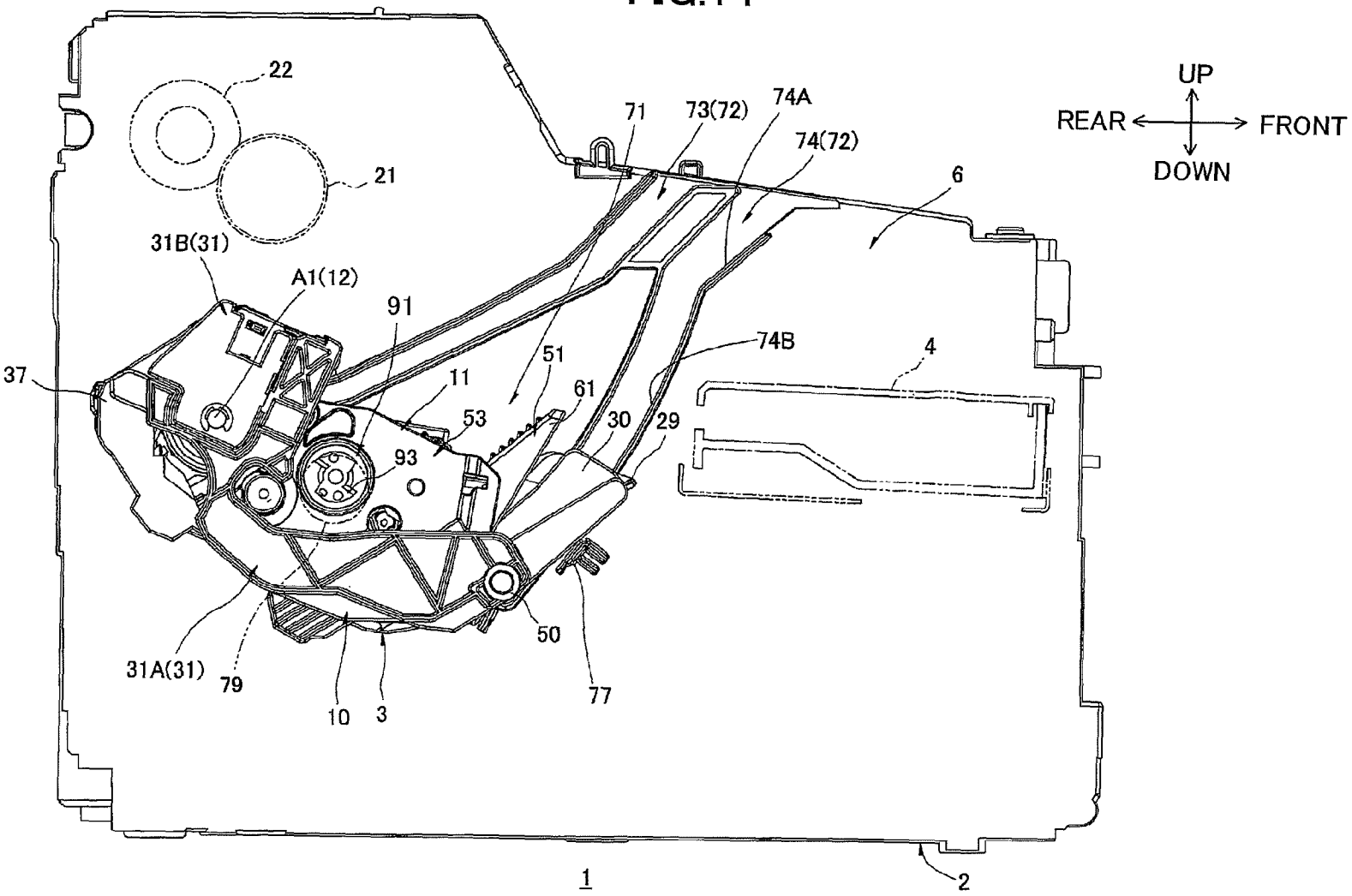
FIG. 14 is a view illustrating positional relationship of a developing coupling relative to a body-side coupling in the state shown in FIG. 13.
Figure 15:
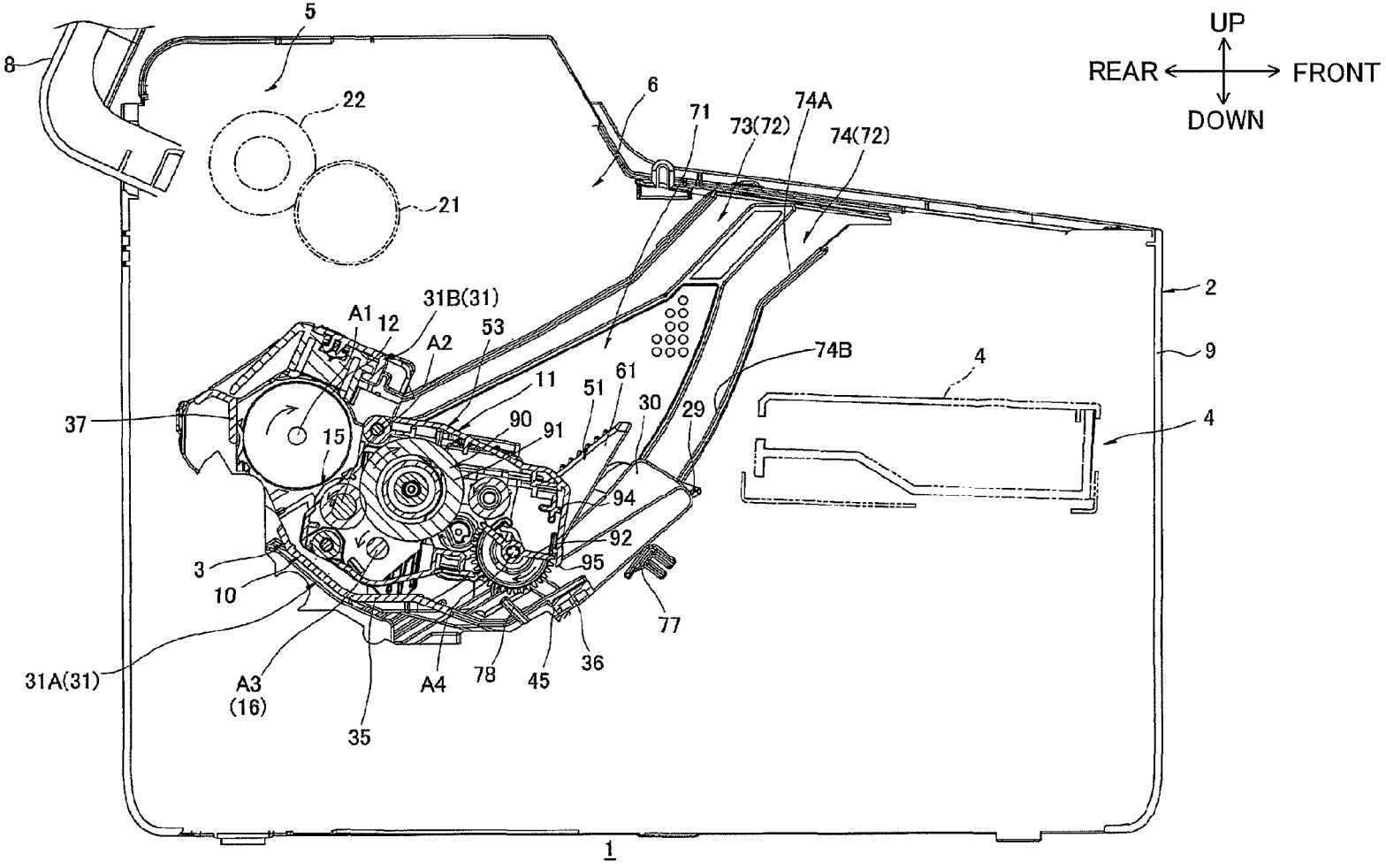
FIG. 15 is a view illustrating positional relationship of an actuator relative to a detection gear in the state shown in FIG. 13, FIG. 15 corresponding to an E-E cross section of the printer shown in FIG. 10.

As illustrated in FIGS. 14 and 15, the drive unit 53 includes a gear train 90 and a gear cover 94 covering the gear train 90. The gear train 90 includes a developing coupling 91 and a detection gear 92.

The developing coupling 91 is disposed approximately at the vertical center of the developing cartridge 11. The developing coupling 91 has a generally columnar shape extending in the left-right direction, and is rotatably supported by the left wall 54L of the developing frame 51. The developing coupling 91 has a right end portion on whose peripheral surface gear teeth are formed. The developing coupling 91 has a left surface in which a coupling recess 93 is formed.

The coupling recess 93 is recessed rightward from the left surface of the developing coupling 91. The coupling recess 93 is formed as a generally elongated hole in a side view and extends in a radial direction of the developing coupling 91. A coupling protrusion (not illustrated) of a body coupling 79 provided in the main casing 2 is configured to be fitted to the coupling recess 93 so that driving force can be transmitted thereto from the main casing 2.

The detection gear 92 is disposed downward and frontward of the developing coupling 91. The detection gear 92 has a flat plate-like shape and has a generally semi-circular shape in a side view. The detection gear 92 has a radial center that is rotatably supported on the left wall 54L of the developing frame 51. Gear teeth are formed on a peripheral surface of the detection gear 92. The detection gear 92 is exposed toward the rear through an opening 95 formed in a rear end portion of the gear cover 94.

The gear train 90 including the developing coupling 91 and the detection gear 92 is connected (mechanically linked) to the developing roller shaft A2, the supply roller shaft A3, and a rotation shaft A4 of the agitator 20. Accordingly, a drive force that is inputted to the developing coupling 91 can be transmitted to the developing roller 15, the supply roller 16, and the agitator 20.

3. Structure of the Main Casing

Figure 7:
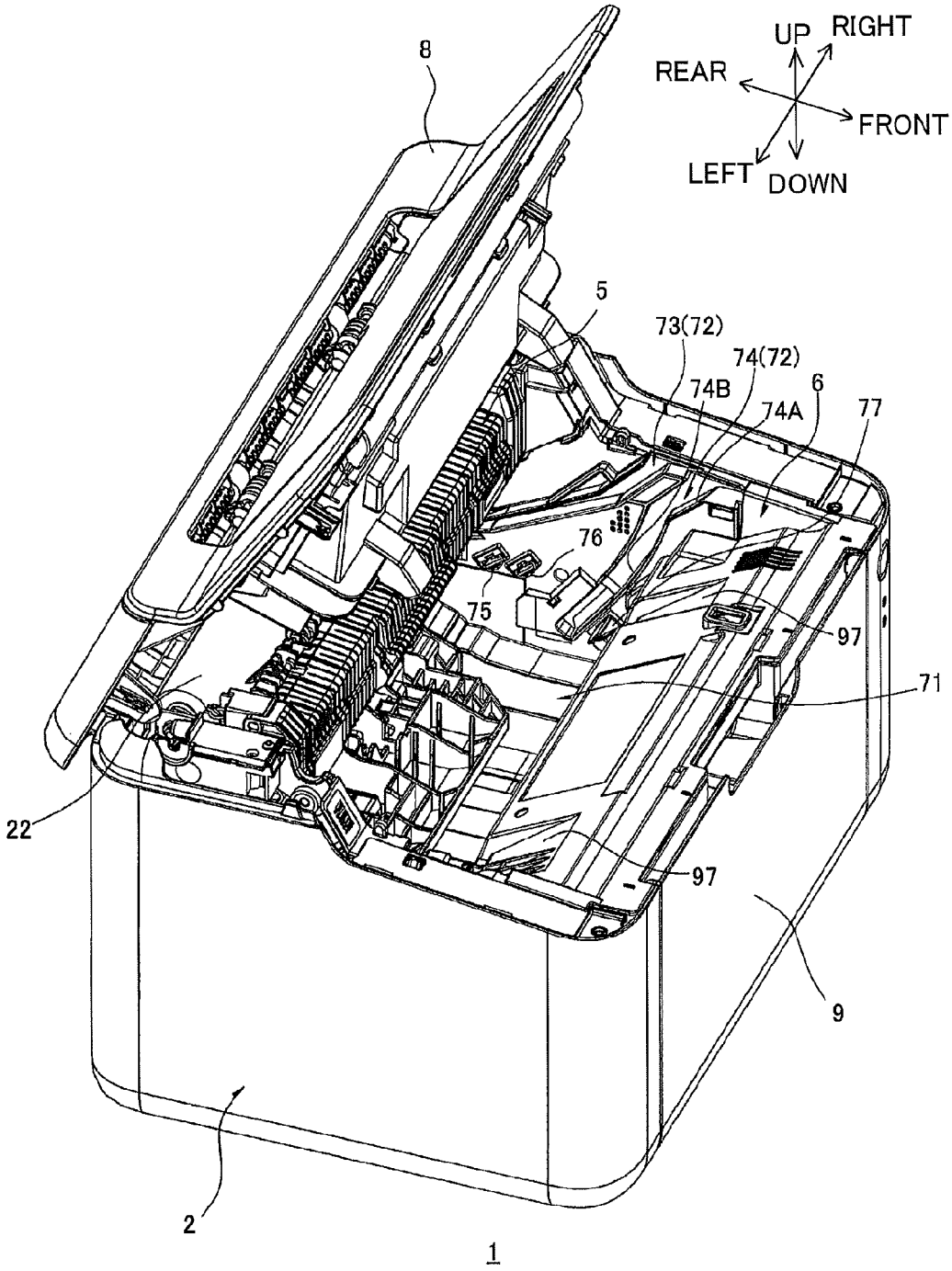
FIG. 7 is a perspective view of a main casing of the printer according to the embodiment shown in FIG. 1 as viewed from an upper-left side thereof.

As illustrated in FIGS. 1 and 7, a process-cartridge accommodating section 71 is defined in the main casing 2 as an example of a cartridge receiving section.

The process-cartridge accommodating section 71 is formed between the fixing unit 5 and a rear-side portion of the sheet placing portion 23. The process-cartridge accommodating section 71 is colored in a color (for example, black) that is different from the color of the cartridge attachment portion 44.

The process-cartridge accommodating section 71 includes a pair of guide parts 72, the body-side developing electrode 75, the body-side supply electrode 76, an opposing member 77 as an example of a fixing member, a pair of restricting-rib passing grooves 97, an actuator 78, and a body coupling 79.

The guide parts 72 are formed in both left and right side walls of the main casing 2 respectively so as to face each other. The guide parts 72 are formed to be recessed into inner surfaces of the respective left and right side walls of the main casing 2 (i.e., each guide part 72 is recessed outward in the left-right direction from the inner surface of the corresponding side wall). Each guide part 72 includes a drum-shaft guide part 73 and a boss guide part 74.

The drum-shaft guide part 73 is formed to provide a slope that extends downward toward the rear from a generally front-rear center portion of an upper end portion of each side wall of the main casing 2. The drum-shaft guide part 73 has a groove width approximately the same as the outer diameter of the drum shaft A1.

The boss guide part 74 is disposed frontward of the drum-shaft guide part 73 to be spaced way therefrom. The boss guide part 74 formed to provide a slope that extends rearward toward the bottom from the upper end portion of each side wall of the main casing 2. The boss guide part 74 has a groove width slightly larger than the outer diameter of the guide boss 50. The boss guide part 74 integrally includes a first portion 74A constituting an upper portion of the boss guide part 74, and a second portion 74B constituting a lower portion of the boss guide part 74.

As shown in FIGS. 11-15, the first portion 74A is positioned on the upper-rear side of the scanner unit 4 to be spaced away therefrom in a side view. The first portion 74A is sloped downward toward the rear from the upper end portion of the each side wall constituting the main casing 2. That is, the first portion 74A is formed to have a slope that is generally identical to the slope of the drum-shaft guide part 73.

The second portion 74B is formed to be continuous from a lower end of the first portion 74A. The second portion 74B is curved rearward toward the bottom, while passing the rear side of the scanner unit 4, to provide a steeper downward slope than the slope of the first portion 74A. That is, a distance between the second portion 74B and the drum-shaft guide part 73 in the front-rear direction increases as the second portion 74B extends toward the bottom-rear side. The second portion 74B has a rear end that is positioned frontward and downward of and spaced away from a rear end of the drum-shaft guide part 73.

The body-side developing electrode 75 is disposed between the rear end of the drum-shaft guide part 73 and the rear end of the boss guide part 74. The body-side developing electrode 75 is formed in a generally annular shape. The body-side developing electrode 75 has a circumferential portion that protrudes leftward from a left surface of the right wall of the main casing 2. The body-side developing electrode 75 is supported on the right side wall of the main casing 2 such that the body-side developing electrode 75 extends in a direction connecting the upper-front and the lower-rear in a side view. The body-side developing electrode 75 is biased leftward by a biasing member (not shown).

The body-side supply electrode 76 is disposed frontward of the body-side developing electrode 75 and between the rear end of the drum-shaft guide part 73 and the rear end of the boss guide part 74. The body-side supply electrode 76 is formed in an approximately annular shape. The body-side supply electrode 76 has a circumferential portion that protrudes leftward from the left surface of the right wall of the main casing 2. The body-side supply electrode 76 is supported on the right side wall of the main casing 2 so as to extend in the direction connecting the upper-front and the lower-rear in a side view. The body-side supply electrode 76 is biased leftward by a biasing member (not shown).

The opposing member 77 is disposed downward and frontward of the rear end of the boss guide part 74. The opposing member 77 is formed in an approximately triangular columnar shape and protrudes leftward from the left surface of the right side wall of the main casing 2.

The restricting rib passing grooves 97 are formed on both ends of a front wall defining the process-cartridge accommodating section 71 in the left-right direction. The restricting-rib passing grooves 97 are formed as grooves recessed downward from an upper surface of the front wall of the process-cartridge accommodating section 71. The restricting-rib passing grooves 97 are configured to allow passage of the restricting ribs 96 of the process cartridge 3 compatible with the printer 1 only, and are configured to restrict passage of restricting ribs 96 of a process cartridge 3 that is not compatible with the printer 1.

As illustrated in FIG. 14, the body coupling 79 is supported on the left side wall of the main casing 2 between the rear end of the drum-shaft guide part 73 and the rear end of the boss guide part 74. The body coupling 79 is configured to retract from the inside of the process-cartridge accommodating section 71 in conjunction with opening of the top cover 8, and to advance into the process-cartridge accommodating section 71 in conjunction with closing of the top cover 8.

As illustrated in FIG. 15, the actuator 78 is supported on a lower wall on a left end portion of the process-cartridge accommodating section 71. The actuator 78 has a generally rod-like shape extending in a direction connecting the upper-rear and the lower-front. The actuator 78 is configured to pivot, about a lower-front end thereof, between a non-detection position (shown in FIG. 15) and a detection position (not illustrated). In the non-detection position, the actuator 78 is erected toward the upper-rear side. In the detection position, the actuator 78 is tilted toward the rear. The actuator 78 is normally biased toward the non-detection position by a biasing member (not illustrated).

The actuator 78 is displaced to the detection position when the detection gear 92 of the developing cartridge 11 makes contact with the actuator 78, and the actuator 78 is configured to be detected by a sensor (not illustrated) provided in the main casing 2. When the detection gear 92 of the developing cartridge 11 does not abut on the actuator 78, the actuator 78 is placed at the non-detection position and is not detected by the sensor (not illustrated) provided in the main casing 2.

The printer 1 is thus configured to detect presence and a specification of the developing cartridge 11 based on whether or not the actuator 78 makes contact with the detection gear 92.

4. Mounting of the Developing Cartridge Relative to the Main Casing

In the printer 1, two kinds of methods are available for mounting the developing cartridge 11 in the main casing 2.

A first mounting method involves: mounting the developing cartridge 11 on the drum cartridge 10, which is detached from the main casing 2, to assemble the process cartridge 3; and then mounting the completed process cartridge 3 on the process-cartridge accommodating section 71 of the main casing 2. A second mounting method involves mounting the developing cartridge 11 on the drum cartridge 10 that has already been mounted in the main casing 2, without removing the drum cartridge 10 from the main casing 2. Hereinafter, both of these two mounting methods will be described in detail.

(1) First Mounting Method

The first mounting method is executed for performing maintenance on the developing cartridge 11 and/or the drum cartridge 10 (for example, when replacing the developing cartridge 11 or the drum cartridge 10).

According to the first mounting method, first of all, the developing cartridge 11 is mounted on the drum cartridge 10.

For mounting the developing cartridge 11 on the drum cartridge 10, an operator first inserts the rear end portion of the developing cartridge 11 into the rear end portion of the cartridge attachment portion 44 of the drum cartridge 10 from above.

Accordingly, as illustrated in FIG. 8A, the restricted part 59 of the developing cartridge 11 makes contact with the restricting part 49 of the lock lever 32 of the drum cartridge 10 from above.

At this time, the sliding surface 49A of the restricting part 49 and the sliding surface 59A of the restricted part 59 are oriented to be inclined slightly relative to the up-down direction.

Subsequently, the front end portion of the developing cartridge 11 is caused to pivot clockwise in a left side view about the rear end portion of the developing cartridge 11.

As illustrated in FIG. 8B, the lock lever 32 is thus pressed frontward by the restricted part 59 of the developing cartridge 11, causing the lock lever 32 to pivot clockwise in a left side view such that the sliding surface 49A slidingly moves on the sliding surface 59A of the restricted part 59.

The restricting part 49 of the lock lever 32 thus retracts from a moving trajectory defined by the restricted part 59 that moves in accordance with the pivoting of the developing cartridge 11. The restricted part 59 is thus permitted to move downward.

As the developing cartridge 11 is pivoted further downward, the front end portion of the developing cartridge 11 is accommodated in the front end portion of the cartridge attachment portion 44, as illustrated in FIG. 8C.

The restricted part 59 of the developing cartridge 11 is now disposed below the restricting part 49 of the lock lever 32, and stops pressing the lock lever 32.

As a result, the lock lever 32 is caused to pivot counterclockwise in a left side view due to the biasing force of the wire spring 81, and the restricting surface 49B of the restricting part 49 of the lock lever 32 are caused to oppose the restricted surface 59B of the restricted part 59 of the developing cartridge 11 from above.

Mounting of the developing cartridge 11 on the drum cartridge 10 is thus completed, thereby completing assembly of the process cartridge 3.

Subsequently, in the first mounting method, the process cartridge 3 is mounted on the process-cartridge accommodating section 71 of the main casing 2.

For mounting the process cartridge 3 on the main casing 2, first, the top cover 8 of the main casing 2 is opened.

As illustrated in FIG. 7, the process-cartridge accommodating section 71 is exposed through the cartridge opening 6.

Subsequently, the operator grasps the drum-cartridge grip 30 of the drum cartridge 10 and inserts the process cartridge 3 into the main casing 2 such that: the left and right ends of the drum shaft A1 of the photosensitive drum 12 are fitted to the respective drum shaft guide portions 73 of the main casing 2; and the guide bosses 50 of the drum cartridge 10 are fitted to the respective boss guide parts 74 of the main casing 2.

Then, the operator causes the process cartridge 3 to pivotally move in a counterclockwise direction in a right side view about the drum shaft A1 of the photosensitive drum 12, while pushing the process cartridge 3 diagonally downward and rearward along the drum-shaft guide parts 73 and the boss guide parts 74. In other words, the direction from the upper-front to the lower-rear and the counterclockwise direction in a right side view are both a mounting direction of the process cartridge 3 relative to the main casing 2.

Figure 9A:
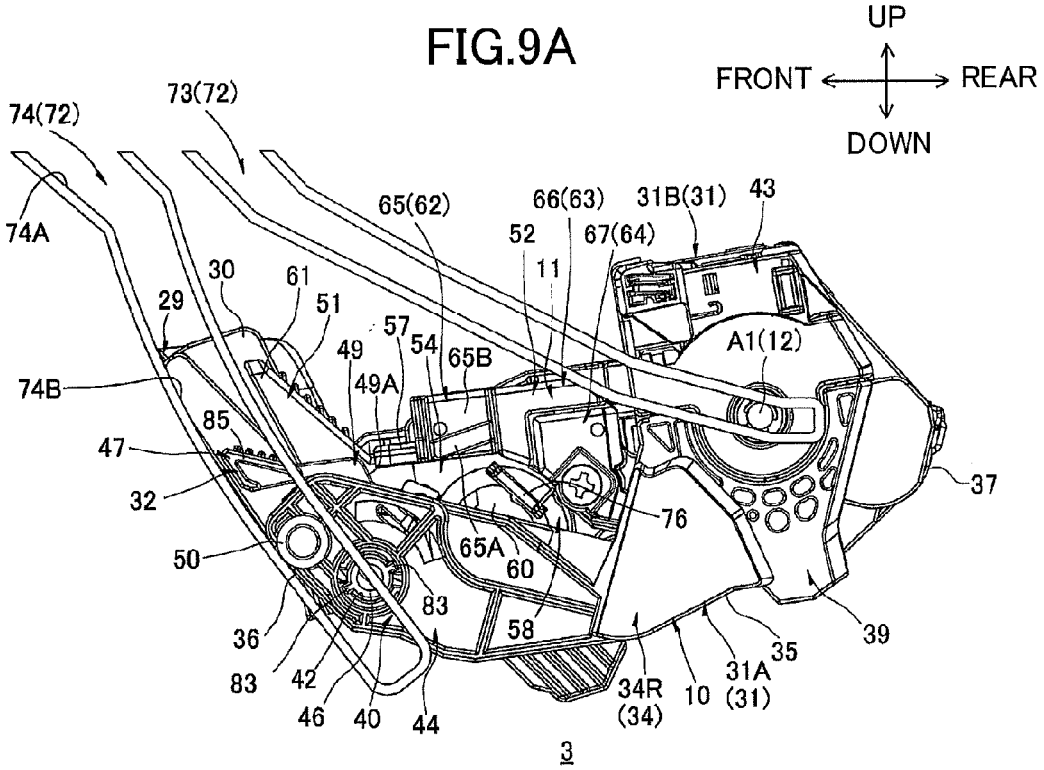
FIG. 9A is an explanatory view illustrating how the process cartridge is mounted in the main casing, in which a supply electrode is about to make contact with a body-side supply electrode.
Figure 9B:
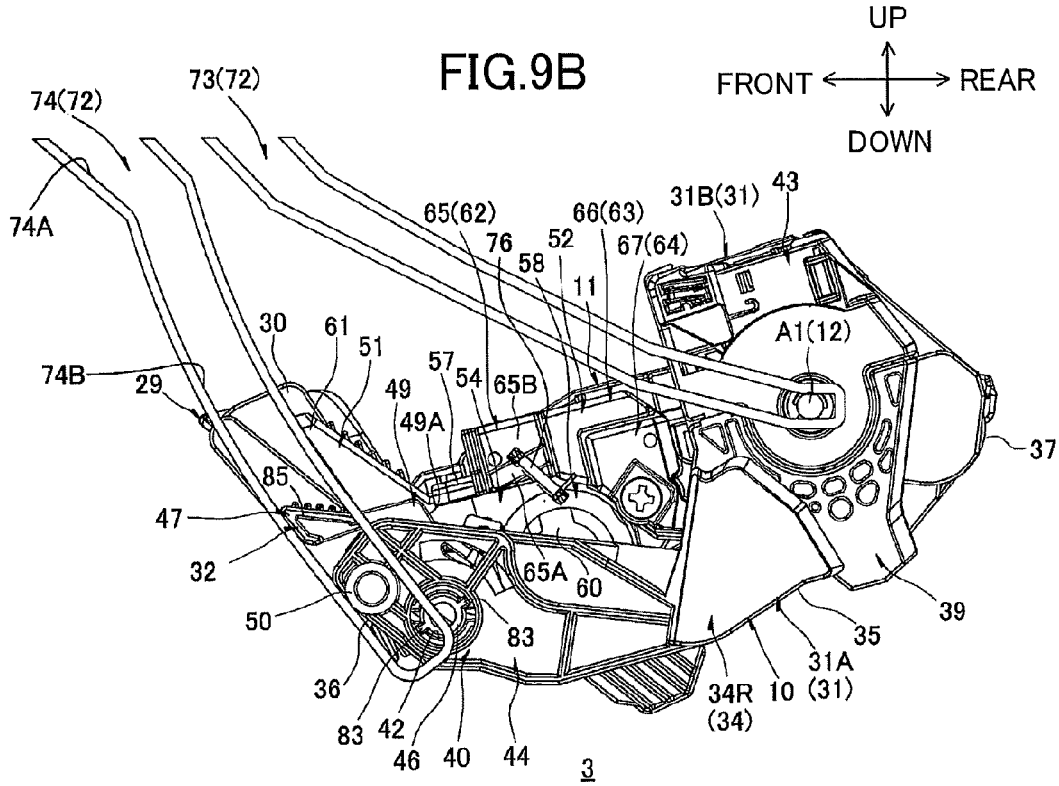
FIG. 9B is an explanatory view illustrating how the process cartridge is mounted in the main casing, in which a guide surface of the supply electrode is contacted by the body-side supply electrode, a body-side developing electrode being omitted in FIGS. 9A and 9B.

As illustrated in FIGS. 9A and 9B, immediately before mounting of the process cartridge 3 on the main casing 2 is completed, in accordance with the pivoting of the process cartridge 3, the body-side supply electrode 76 in the main casing 2 is brought into contact with the guiding surface 65A of the supply-side contact 65 from below.

The body-side supply electrode 76 slides on and along the guiding surface 65A and moves upward relative to the guiding surface 65A, while being displaced rightward along the slope of the guiding surface 65A against the biasing force applied to the body-side supply electrode 76. The body-side supply electrode 76 thus moves from the guiding surface 65A onto the contact surface 65B and makes contact with the contact surface 65B. The body-side supply electrode 76 and the supply electrode 62 are thus electrically connected to each other.

Figure 10:
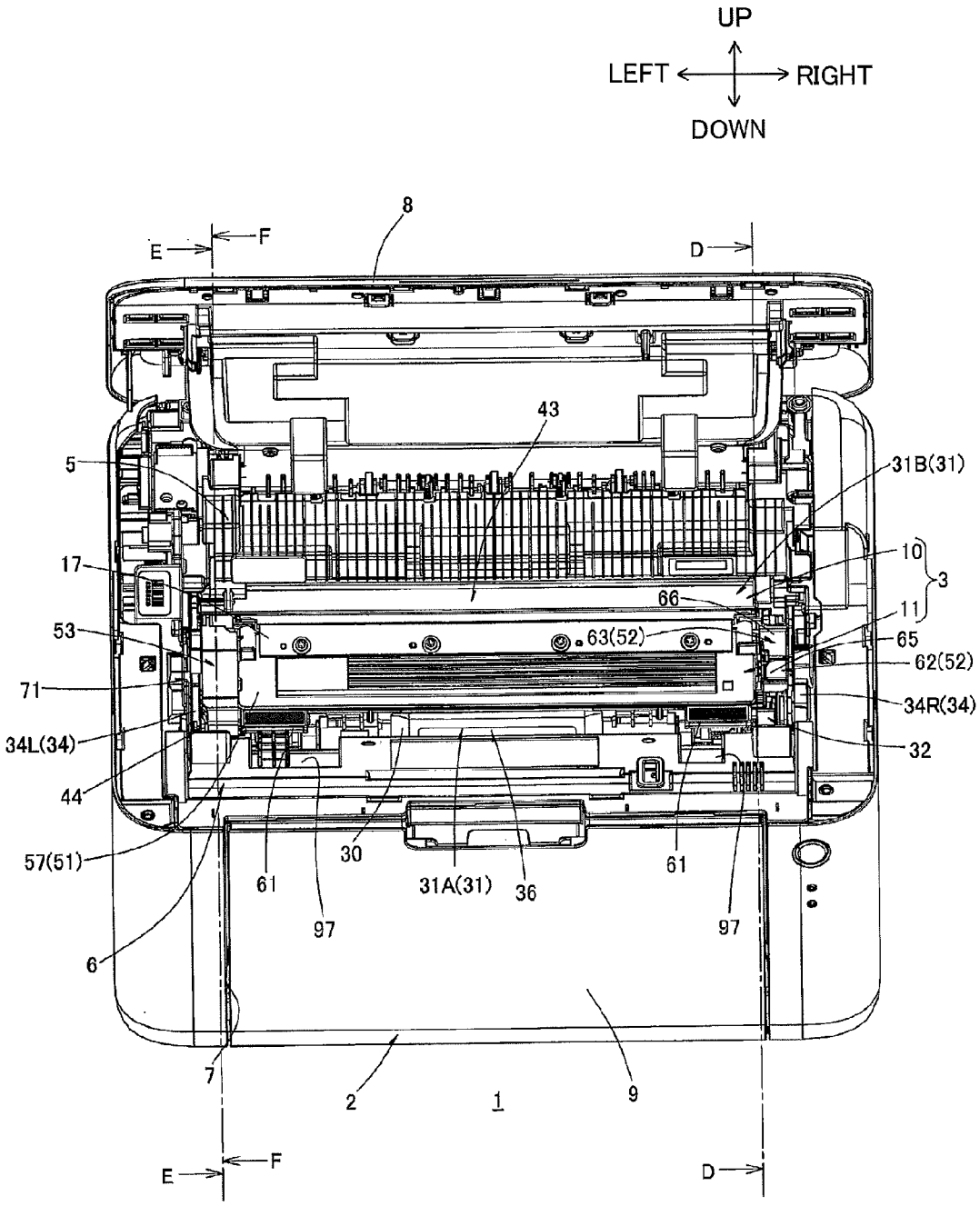
FIG. 10 is a perspective view of the printer according to the embodiment as viewed from an upper-front side thereof, in which mounting of the process cartridge in the main casing has been completed.

When the front end portion of the process cartridge 3 has moved to be located below the trajectory of the laser beam L shown in FIG. 1, the process cartridge 3 is accommodated in the process-cartridge accommodating section 71 as shown in FIG. 10. Mounting of the process cartridge 3 on the main casing 2 is thus completed.

Figure 11:
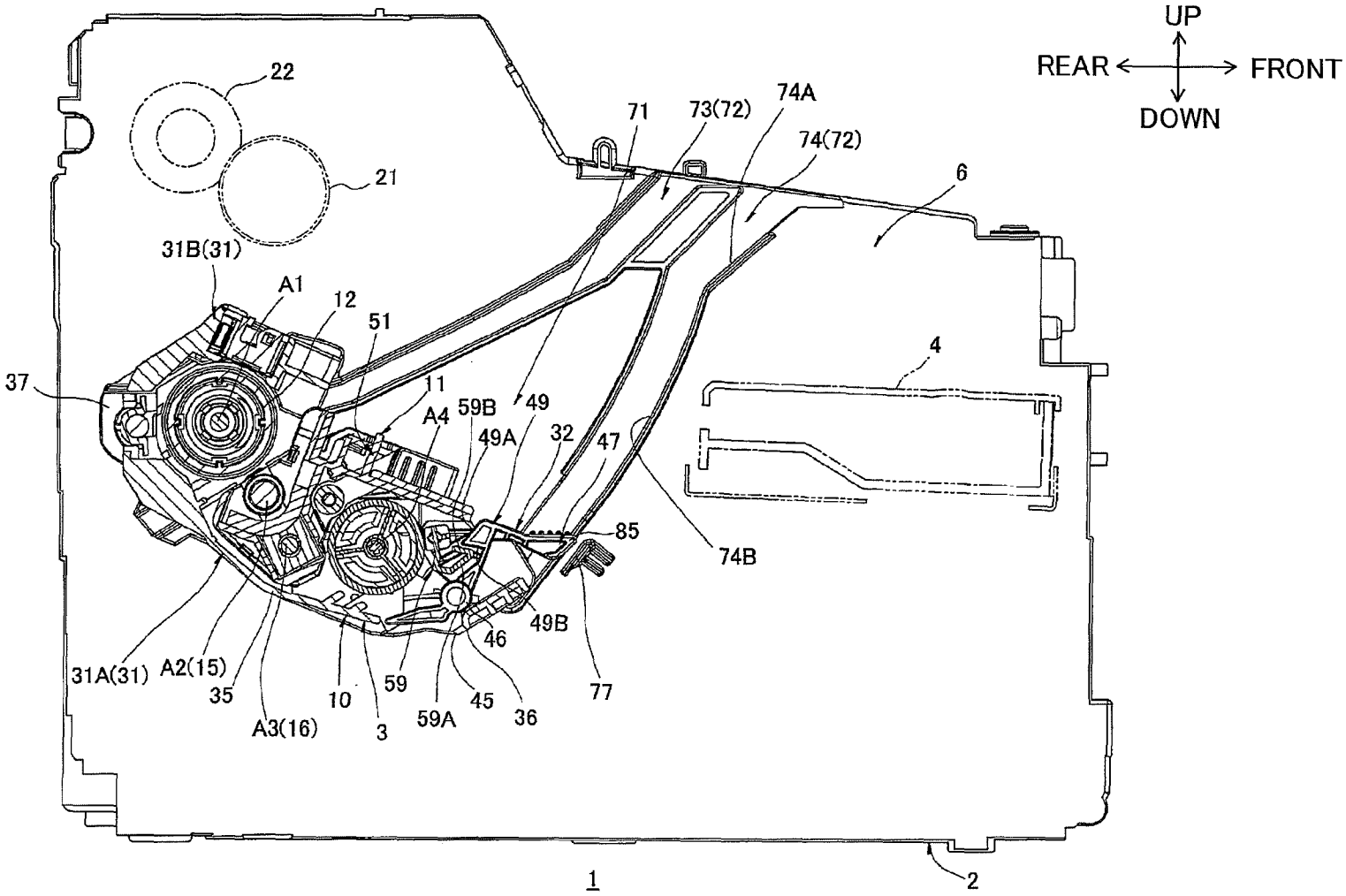
FIG. 11 is a cross-sectional view of the printer according to the embodiment taken along a D-D plane shown in FIG. 10, in which mounting of the process cartridge in the main casing has been completed.
Figure 18A:
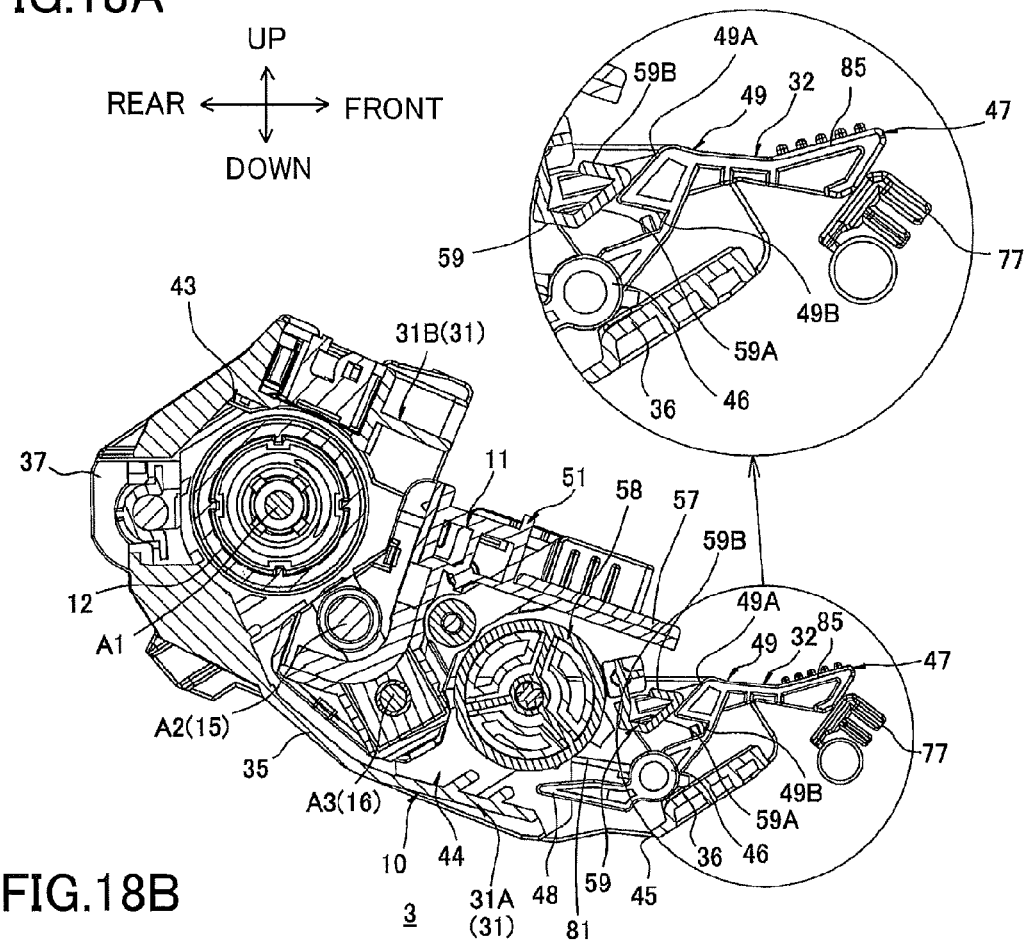
FIG. 18A is an explanatory cross-sectional view taken along the plane corresponding to the D-D plane shown in FIG. 10, illustrating attachment of the developing cartridge to the drum cartridge mounted on the main casing after the state of FIGS. 17A and 17B, in which the restricted part of the developing cartridge presses the restricting part of the lock lever to cause resilient deformation of the lock lever.
Figure 18B:
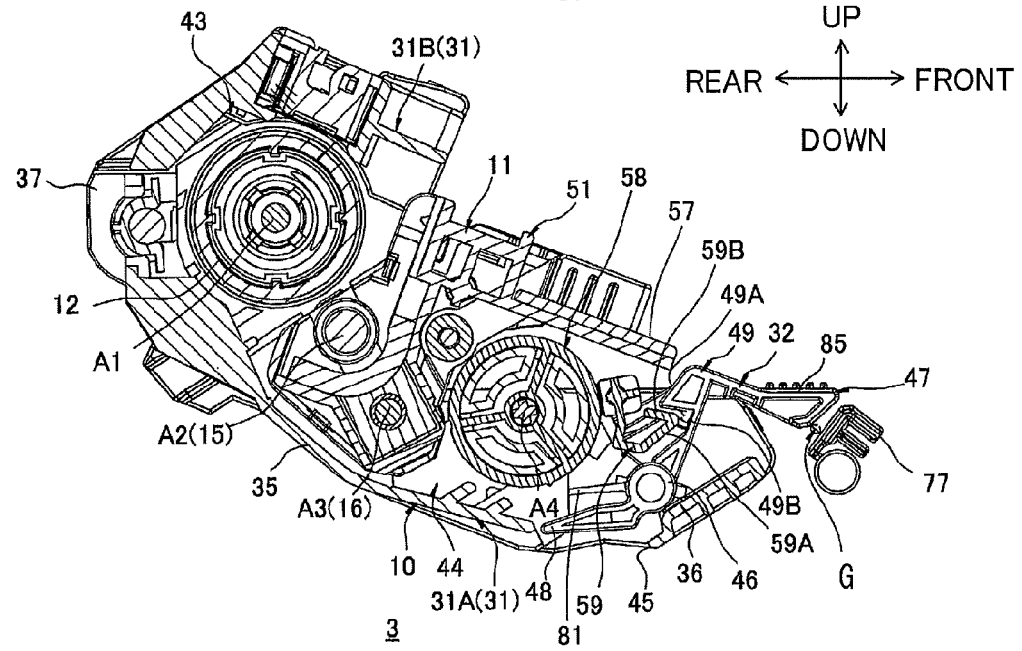
FIG. 18B an explanatory cross-sectional view taken along the plane corresponding to the D-D plane shown in FIG. 10, illustrating attachment of the developing cartridge to the drum cartridge mounted on the main casing after the state of FIG. 18A, in which the lock lever restores its original shape and the restricting part of the lock member faces the restricted part of the developing cartridge from above.

At this time, as illustrated in FIG. 11, the opposing member 77 in the main casing 2 opposes the front end of the operation portion 47 of the lock lever 32 (in the locking position) from the lower-front side thereof with a small gap G defined therebetween (see FIGS. 17A and 18B).

With this structure, the opposing member 77 functions to restrict the lock lever 32 from moving from the locking position to the unlocking position. The lock lever 32 is thus substantially fixed at the locking position.

In this way, in a state where the process cartridge 3 has been mounted on the main casing 2, detachment of the developing cartridge 11 from the drum cartridge 10 can be restricted.

Finally, the top cover 8 of the main casing 2 is closed.

For removing the developing cartridge 11 from the main casing 2, the operation for mounting the developing cartridge 11 on the main casing 2 described above is performed in reverse.

Specifically, after the top cover 8 is opened, the process cartridge 3 is pulled upward and frontward to remove the process cartridge 3 from the main casing 2. Once the process cartridge 3 is removed from the main casing 2, the lock lever 32 is moved to the unlocking position and the front end portion of the developing cartridge 11 is then pivoted about the rear end portion of the developing cartridge 11 in the counterclockwise direction in a left side view (in other words, in the clockwise direction in a right side view). The developing cartridge 11 is then separated upward from the drum cartridge 10.

Incidentally, in the mounting operation described above, there may be a case where the developing cartridge 11 is not completely mounted on the drum cartridge 10. More specifically, as illustrated in FIG. 8B, when the developing cartridge 11 is not completely mounted on the drum cartridge 10, the front end of the restricted part 59 of the developing cartridge 11 is in abutting contact with the restricting part 49 of the lock lever 32. This position of the lock lever 32 shown in FIG. 8B is a half-locking position which represents a state of the lock lever 32 between the locking position and the unlocking position.

When the lock lever 32 is in the half-locking position, the developing cartridge 11 can be detached from the drum cartridge 10.

Figure 12:
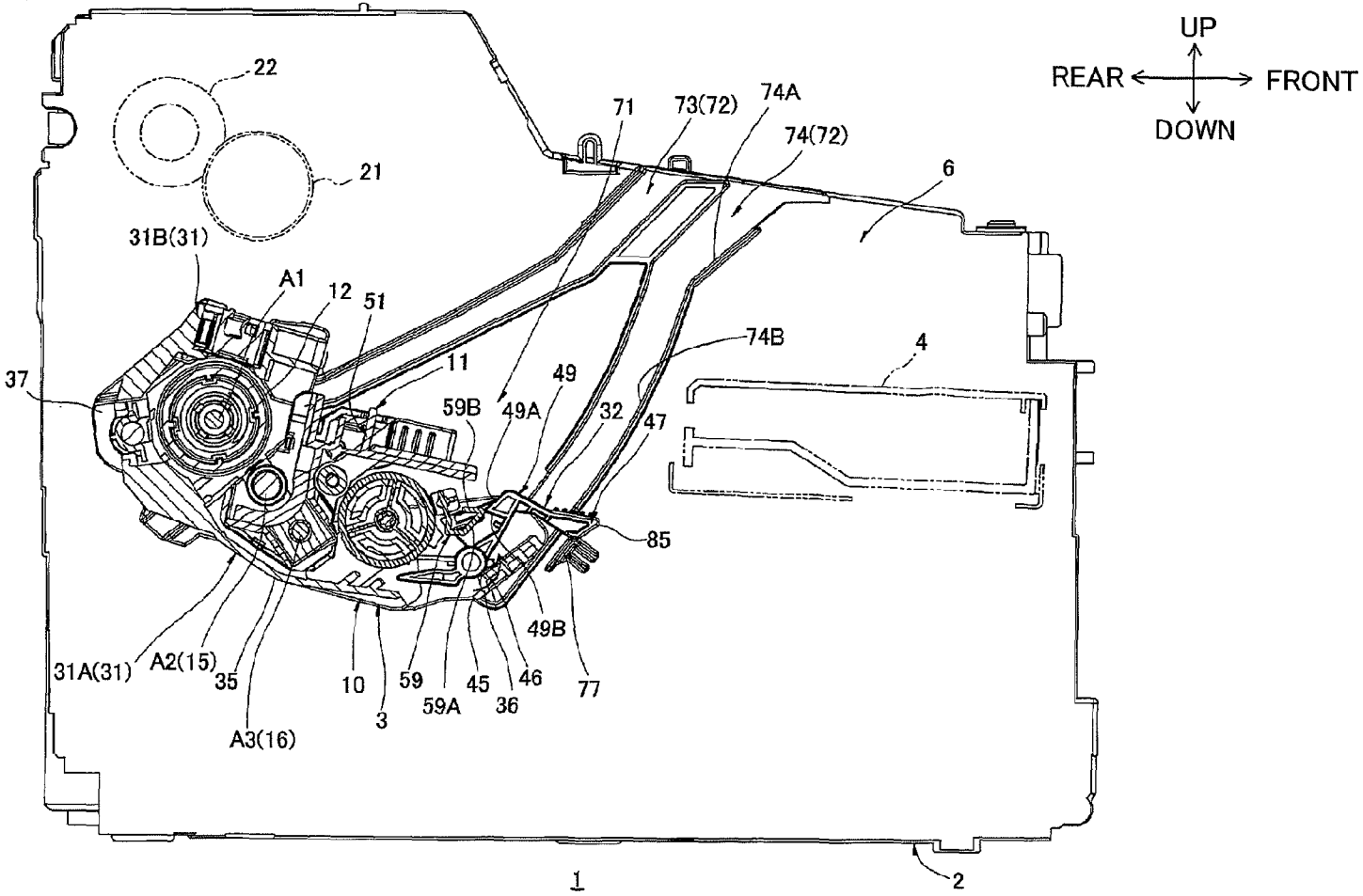
FIG. 12 is a cross-sectional view of the printer 1 according to the embodiment taken along the D-D plane shown in FIG. 10, in which the process cartridge is mounted on the main casing in a state where the developing cartridge has not yet completely attached to the drum cartridge.

As illustrated in FIG. 12, if the process cartridge 3 is inserted into the main casing 2 in a state where the lock lever 32 is in the half-locking position, the front end of the operation portion 47 of the lock lever 32 is brought into contact with the opposing member 77 of the main casing 2 from above.

In this case, when the process cartridge 3 is inserted further into the main casing 2, the lock lever 32 is caused to pivot counterclockwise in a left side view by repulsive force from the opposing member 77, bringing the lock lever 32 into the locking position.

At this time, if the restricting part 49 of the lock lever 32 is in abutment with the restricted surface 59B rather than the sliding surface 59A, the restricting part 49 of the lock lever 32 presses the restricted part 59 downward, which in turn causes the developing cartridge 11 to pivot clockwise in a left side view. The developing cartridge 11 is thus completely mounted on the cartridge attachment portion 44 of the drum cartridge 10.

Figure 13:
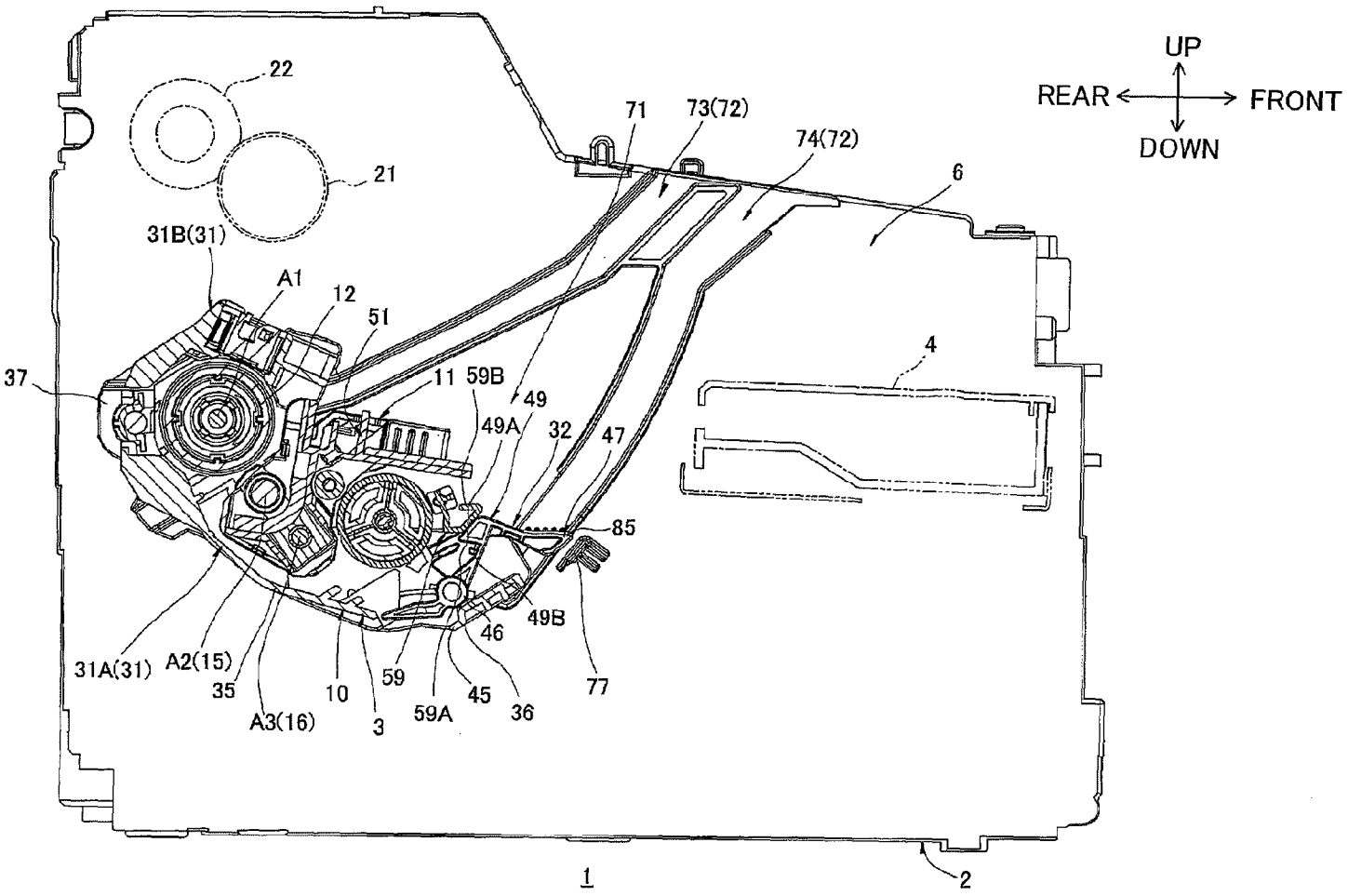
FIG. 13 is an explanatory cross-sectional view of the printer 1 according to the embodiment after the state of FIG. 12, in which the process cartridge is mounted on the main casing in a state where the developing cartridge has not yet completely attached to the drum cartridge and a front end portion of the developing cartridge is pushed up by the lock lever.

On the other hand, if the restricting part 49 of the lock lever 32 is in abutment with the sliding surface 59A rather than the restricted surface 59B, the restricting part 49 of the lock lever 32 presses the sliding surface 59A upward, which causes the developing cartridge 11 to pivot in the counter-clockwise direction in a left side view and to be lifted upward relative to the cartridge attachment portion 44, as shown in FIG. 13.

If this is the case, as illustrated in FIG. 14, the developing coupling 91 of the developing cartridge 11 is disposed at a position offset upward relative to the body coupling 79 in a side view. In other words, even if the top cover 8 is closed, the body coupling 79 is not able to be fitted to the developing coupling 91 and the driving force is not inputted to the developing cartridge 11.

Accordingly, the developing cartridge 11 can be prevented from being driven when the developing cartridge 11 is not completely attached to the drum cartridge 10. Any damage to the developing cartridge 11 can be suppressed.

Further, as illustrated in FIG. 15, the detection gear 92 of the developing cartridge 11 is positioned to oppose the actuator 78 from above and to be spaced apart therefrom.

That is, the actuator 78 and the detection gear 92 do not make contact with each other. Thus, neither whether the developing cartridge 11 is mounted nor the specification of the developing cartridge 11 is mounted is not detected.

Accordingly, a controller (not illustrated) provided in the printer 1 determines that the developing cartridge 11 is not mounted, and controls a notification unit (not illustrated) to inform the operator that the developing cartridge 11 is not mounted.

Summing up, even if the process cartridge 3 in the state illustrated in FIG. 12 is inserted into the main casing 2, the image forming operation can be performed if the developing cartridge 11 can be completely mounted on the drum cartridge 10 by the lock lever 32 as illustrated in FIG. 11 during the mounting process of the process cartridge 3 on the main casing 2.

On the other hand, if the process cartridge 3 in the state illustrated in FIG. 12 is inserted into the main casing 2 and the developing cartridge 11 is subsequently pulled out from the drum cartridge 10 by the lock lever 32 as illustrated in FIG. 13 during the mounting process of the process cartridge 3 on the main casing 2, the driving force cannot be inputted to the developing cartridge 11 as illustrated in FIG. 14 and the presence and the specification of the developing cartridge 11 cannot be detected as illustrated in FIG. 15.

As described above, the developing cartridge 11 can be prevented from being driven when not completely attached to the drum cartridge 10. At the same time, the operator can be notified that the developing cartridge 11 is not mounted.

(2) Second Mounting Method

The second mounting method is executed for unpacking the printer 1 that is packed with the drum cartridge 10 mounted in the main casing 2 (during shipment of the printer 1, for example), and then installing the unpacked printer 1.

Incidentally, such packaging is particularly ideal in order to suppress deterioration of toner in the developing cartridge 11 and to conserve space during transportation of the printer 1. Specifically, when packing the printer 1, the developing cartridge 11 is applied with special treatments such as damp-proof treatment and heat-shielding treatment and is disposed outside the main casing 2, while the drum cartridge 10 is accommodated in the main casing 2. In other words, the drum cartridge 10 is housed in the main casing 2, the developing cartridge 11 is arranged outside the main casing 2, and the main casing 2 and the developing cartridge 11 are wrapped together as a single package.

For mounting the developing cartridge 11 on the main casing 2 according to the second mounting method, first, the top cover 8 of the main casing 2 is opened.

Figure 16:
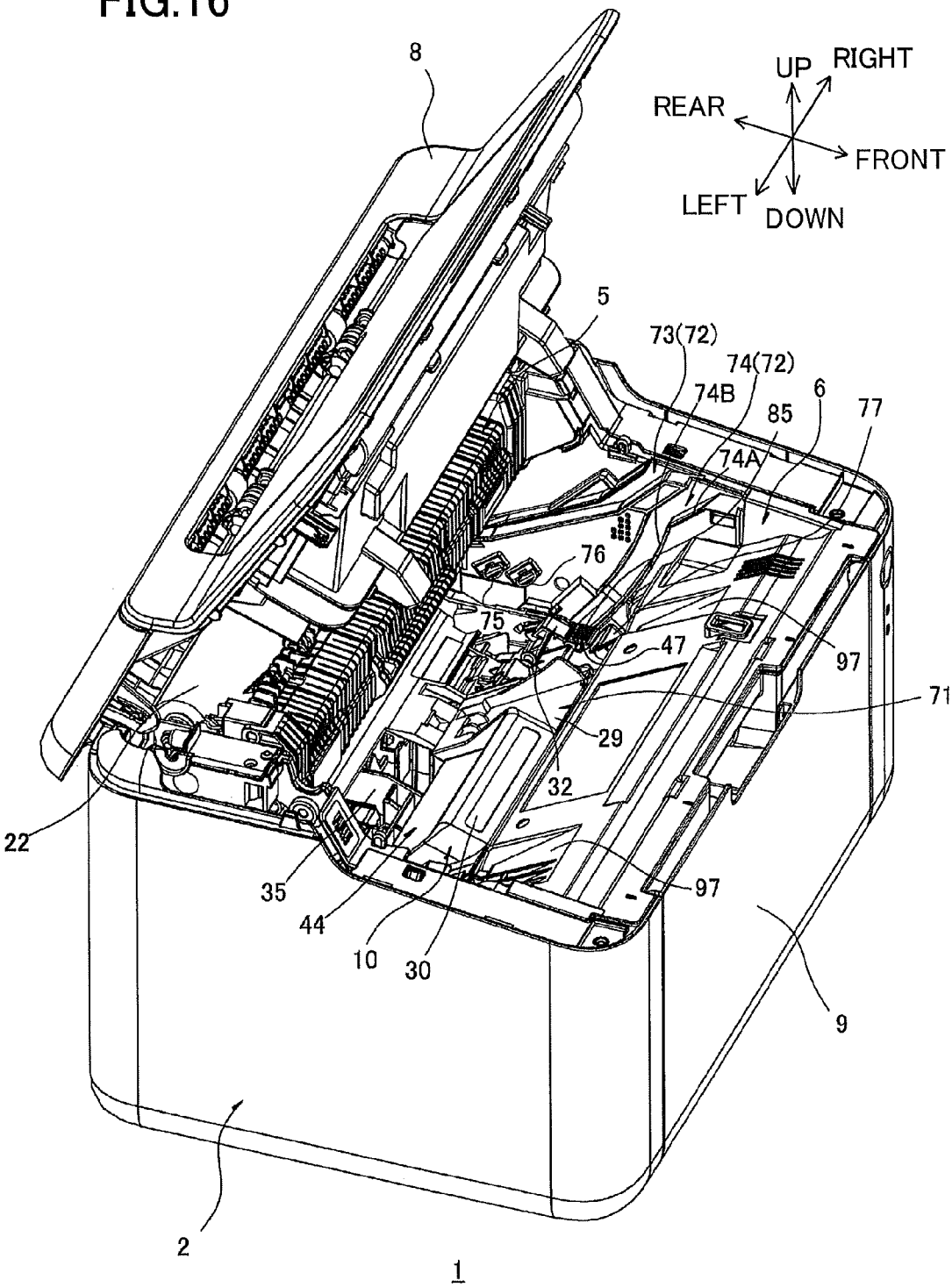
FIG. 16 is a perspective view of the printer according to the embodiment as viewed from an upper-left side thereof, in which only the drum cartridge is mounted on the main casing.

Thus, as illustrated in FIG. 16, since the drum cartridge 10 has already been mounted in the main casing 2, the cartridge attachment portion 44 of the drum cartridge 10 is exposed outside through the cartridge opening 6.

Subsequently, the operator holds the developing cartridge 11 and inserts the rear end portion of the developing cartridge 11 into the rear end portion of the cartridge attachment portion 44 of the drum cartridge 10 from above, as illustrated in FIG. 17A.

As in the mounting process of the developing cartridge 11 on the drum cartridge 10 described earlier, the front end portion of the developing cartridge 11 is pivoted in the counter-clockwise direction in a right side view (i.e., in the clockwise direction in a left side view) about the rear end portion of the developing cartridge 11. That is, the counter-clockwise direction in a right side view is an attaching direction of the developing cartridge 11 relative to the drum cartridge 10 that has been mounted on the main casing 2.

Then, as illustrated in FIG. 17B, in accordance with pivoting of the developing cartridge 11, the body-side supply electrode 76 in the main casing 2 is contacted by the guiding surface 65A of the supply-side contact 65 from below.

Also, as illustrated in FIG. 13, the sliding surface 59A of the restricted part 59 of the developing cartridge 11 is brought into abutment with the sliding surface 49A of the lock lever 32 of the drum cartridge 10 from above.

At this time, the sliding surface 49A and sliding surface 59A are respectively oriented to be inclined slightly rearward toward the bottom (generally in the pivoting direction (or attaching direction) of the developing cartridge 11).

The opposing member 77 in the main casing 2 faces the front end of the operation portion 47 of the lock lever 32 from the lower-front side thereof to be spaced away therefrom by a small gap.

Subsequently, the operator presses the developing-cartridge grips 61 to the lower-rear side to cause the front end portion of the developing cartridge 11 to pivot in the counter-clockwise direction in a right side view.

As a result, as illustrated in FIG. 18A, since the lock lever 32 is pressed frontward by the restricted part 59 of the developing cartridge 11, the lock lever 32 is pivoted slightly clockwise in a left side view, which causes the abutting part 85 to contact the opposing member 77 and also causes a portion of the lock lever 32 near the restricting part 49 (specifically the portion between the pivot shaft 46 and the restricting part 49) to resiliently deform downward and frontward.

The restricting part 49 of the lock lever 32 thus retracts from the moving trajectory of the restricted part 59 associated with the pivoting of the developing cartridge 11. The restricted part 59 of the developing cartridge 11 is thus permitted to move downward.

The restricted part 59 of the developing cartridge 11 passes the rear side of the restricting part 49 downward, while sliding on and along the sliding surface 49A of the restricting part 49 of the lock lever 32.

In the meantime, the body-side supply electrode 76 slidingly moves on and along the guiding surface 65A and moves upward relative to the guiding surface 65A, while being displaced rightward along the slope of the guiding surface 65A against the biasing force applied to the body-side supply electrode 76. The body-side supply electrode 76 thus moves from the guiding surface 65A onto the contact surface 65B and makes contact with the contact surface 65B. The body-side supply electrode 76 and the supply electrode 62 are thus electrically connected to each other.

When the front end portion of the developing cartridge 11 is accommodated in the front end portion of the cartridge attachment portion 44, the lock lever 32 restores its original shape and is pivoted in the counter-clockwise direction in a left side view due to the biasing force of the wire spring 81, as illustrated in FIG. 18B. The restricting surface 49B of the restricting part 49 of the lock lever 32 is thus positioned to face the restricted surface 59B of the restricted part 59 of the developing cartridge 11 from above.

The restricting surface 49B and the restricted surface 59B are inclined slightly upward toward the front such that the restricting surface 49B and restricted surface 59B extend to intersect the pivoting direction of the developing cartridge 11.

Mounting of the developing cartridge 11 on the main casing 2 is thus completed.

Once the developing cartridge 11 has been completely mounted on the main casing 2, the developing cartridge 11 is restricted from getting detached from the drum cartridge 10 since the opposing member 77 restricts the movement of the lock lever 32 from the locking position to the unlocking position.

More specifically, as described above, the sliding surfaces 49A and 59A are inclined in a direction extending slightly rearward toward the bottom (generally in the pivoting direction (or attaching direction) of the developing cartridge 11).

Hence, when the developing cartridge 11 is mounted on the drum cartridge 10 mounted in the main casing 2, even if the abutting part 85 is in contact with the opposing member 77, the restricted part 59 of the developing cartridge 11 slidingly moves on and along the sliding surface 49A of the lock lever 32, while pressing the restricting part 49 and resiliently deforming the lock lever 32, in accordance with the pivoting of the developing cartridge 11. The restricted part 59 can thus ride over and move past the restricting part 49.

In this way, the developing cartridge 11 can be mounted on the drum cartridge 10 mounted in the main casing 2.

On the other hand, the restricting surface 49B and the restricted surface 59B are inclined in a direction extending slightly upward toward the front that intersects the pivoting direction of the developing cartridge 11.

Hence, when the developing cartridge 11 were to be separated from the drum cartridge 10 mounted in the main casing 2, the restricted part 59 of the developing cartridge 11 gets stuck with the restricting part 49 of the lock lever 32 from the bottom-rear side even if the lock lever 32 were to be pivoted by the amount corresponding to the gap G between the abutting part 85 and the opposing member 77. That is, the restricted part 59 of the developing cartridge 11 cannot ride over the restricting part 49 of the lock lever 32.

In this way, detachment of the developing cartridge 11 from the drum cartridge 10 can be restricted.

Finally, the top cover 8 of the main casing 2 is closed.

Incidentally, for removing the developing cartridge 11 from the main casing 2, first, the process cartridge 3 is pulled out toward the upper-front side after the top cover 8 is opened, as described above. That is, the developing cartridge 11 is dismounted from the process-cartridge accommodating section 71 of the main casing 2 together with the drum cartridge 10. Subsequently, outside the main casing 2, the operator moves the lock lever 32 to the unlocking position and pivotally moves the front end portion of the developing cartridge 11 toward the upper-rear side about the rear end portion of the developing cartridge 11, separating the developing cartridge 11 upward from the drum cartridge 10.

5. Operational Advantages (1) According to the printer 1 of the embodiment, as illustrated in FIGS. 16, 17A, and 17B, the developing cartridge 11 can be attached to the drum cartridge 10 in a state where the drum cartridge 10 is mounted in the process-cartridge accommodating section 71 of the main casing 2.

With this structure, the printer 1 can be packed with the drum cartridge 10 housed in the main casing 2, while the developing cartridge 11 can be treated differently from the main casing 2 and the drum cartridge 10 and applied with special treatments such as damp-proof treatment and heat-shielding treatment. The printer 1 wrapped in this way can be downsized.

Further, after the printer 1 is unpacked, the developing cartridge 11 can be mounted on the main casing 2 without detaching the drum cartridge 10 from the main casing 2. Installation of the printer 1 can therefore be facilitated.

On the other hand, the operator may wish to remove the developing cartridge 11 from the main casing 2 (for example, for the purpose of maintenance on the developing cartridge 11 that is being used or used up). Detachment of the developing cartridge 11 from the drum cartridge 10 is restricted, as illustrated in FIG. 11. That is, the developing cartridge 11 alone cannot be removed from the main casing 2. Hence, for removing the developing cartridge 11 from the main casing 2, the process cartridge 3 having the developing cartridge 11 and the drum cartridge 10 needs to be dismounted first from the process-cartridge accommodating section 71 of the main casing 2.

This means that maintenance on the drum cartridge 10 can also be reliably performed when maintenance is performed on the developing cartridge 11.

In summary, with the structure of the printer 1 according to the embodiment, maintenance can be reliably performed on both the developing cartridge 11 and the drum cartridge 10, while the package size can be made compact.

(2) As illustrated in FIG. 11, the developing cartridge 11, which is mounted on the process-cartridge accommodating section 71 together with the drum cartridge 10, can be removed from the process-cartridge accommodating section 71 together with the drum cartridge 10.

This structure ensures reliable removal of the drum cartridge 10 from the main casing 2 at the time of detachment of the developing cartridge 11 from the main casing 2.

(3) As illustrated in FIG. 18A, when the developing cartridge 11 is to be mounted on the drum cartridge 10 that has been mounted on the process-cartridge accommodating section 71, the lock lever 32 can resiliently deform to allow the developing cartridge 11 to be mounted on the drum cartridge 10.

In other words, when in the locking position (restricting position), the lock lever 32 is configured to resiliently deform so as to allow the developing cartridge 11 to be mounted on the drum cartridge 10, while restricting detachment of the developing cartridge 11 from the drum cartridge 10.

Hence, even when the lock lever 32 is fixed at the locking position (restricting position) by the opposing member 77 of the main casing 2, the developing cartridge 11 can be mounted on the drum cartridge 10 that is mounted on the process-cartridge accommodating section 71, due to the resilient deformation of the lock lever 32.

Further, when the mounting of the developing cartridge 11 on the drum cartridge 10 mounted on the process-cartridge accommodating section 71 is completed, the lock lever 32 can restore its original shape as illustrated in FIG. 18B.

With this structure, the developing cartridge 11 can be mounted on the drum cartridge 10 mounted in the process-cartridge accommodating section 71, and once mounted, the developing cartridge 11 can be reliably restricted from getting detached from the drum cartridge 10.

(4) As illustrated in FIGS. 6, 8C and 18B, the developing cartridge 11 is provided with the restricted part 59 that is configured to be restricted (engaged) by the restricting part 49 of the lock lever 32.

The engagement between the restricting part 49 provided on the drum cartridge 10 and the restricted part 59 provided on the developing cartridge 11 can reliably prevent detachment of the developing cartridge 11 from the drum cartridge 10.

(5) As illustrated in FIGS. 8A-8C, 18A and 18B, for mounting the developing cartridge 11 on the drum cartridge 10, the sliding surface 59A of the restricted part 59 is slidingly moved on and along the sliding surface 49A of the lock lever 32. This structure permits mounting of the developing cartridge 11 on the drum cartridge 10.

On the other hand, as illustrated in FIG. 11, after the developing cartridge 11 has been completely mounted on the drum cartridge 10, the restricting surface 49B of the lock lever 32 is arranged to face the restricted surface 59B of the restricted part 59 that extends along the restricting surface 49B, thereby reliably restricting detachment of the developing cartridge 11 from the drum cartridge 10.

(6) As illustrated in FIG. 18A, when the abutting part 85 of the lock lever 32 is in contact with the opposing member 77, the sliding surface 49A disposed between the pivot shaft 46 and the abutting part 85 is pressed to cause the lock lever 32 to resiliently deform easily.

(7) The drum-cartridge grip 30 is disposed at the center of the drum cartridge 10 in the left-right direction as shown in FIG. 5, and the developing-cartridge grips 61 are disposed on both ends of the developing cartridge 11 in the left-right direction, as shown in FIG. 6.

With this structure, even when the drum cartridge 10 and the developing cartridge 11 are assembled together, the operator can easily grasp the drum-cartridge grip 30 and the developing-cartridge grips 61.

(8) As illustrated in FIGS. 9A, 9B, 17A and 17B, in each of the cases where the developing cartridge 11 alone is mounted on the drum cartridge 10 mounted on the process-cartridge accommodating section 71 and where the process cartridge 3 is mounted on the process-cartridge accommodating section 71, the supply electrode 62 of the developing cartridge 11 can be brought into contact with the body-side supply electrode 76 from substantially the same direction.

This configuration can prevent damage to the body-side supply electrode 76 due to contact with the developing cartridge 11 from an unexpected direction.

Incidentally, similarly to the supply electrode 62 and the body-side supply electrode 76, the developing electrode 64 and the body-side developing electrode 75 are also brought into contact with each other from substantially the same direction in both cases (when the developing cartridge 11 is mounted on the drum cartridge 10 mounted on the process-cartridge accommodating section 71; and when the process cartridge 3 is mounted on the process-cartridge accommodating section 71).

(9) As illustrated in FIGS. 9A and 9B, the guide parts 72 can ensure smooth mounting of the process cartridge 3 relative to the process-cartridge accommodating section 71.

(10) In the printer 1 according to the embodiment, the cartridge attachment portion 44 of the drum cartridge 10 is exposed outside through the cartridge opening 6 of the main casing 2 when the drum cartridge 10 alone is mounted on the process-cartridge accommodating section 71 of the main casing 2, as illustrated in FIG. 16.

Therefore, when only the drum cartridge 10 is mounted in the process-cartridge accommodating section 71, the developing cartridge 11 can be mounted directly on the cartridge attachment portion 44 through the cartridge opening 6.

(11) The cartridge attachment portion 44 and the process-cartridge accommodating section 71 are colored in different colors from each other. Specifically, the process-cartridge accommodating section 71 of the main casing 2 is colored in black, while the cartridge attachment portion 44 of the drum cartridge 10 is colored in green.

This configuration allows the operator to easily identify the cartridge attachment portion 44 when the drum cartridge 10 alone is mounted in the process-cartridge accommodating section 71.

Hence, the operator can reliably mount the developing cartridge 11 on the cartridge attachment portion 44 in a state where the drum cartridge 10 has already been mounted on the process-cartridge accommodating section 71.

(12) The base frame 31A and the cover frame 31B are colored in different colors from each other (the base frame 31A is green, while the cover frame 31B is black).

The cartridge attachment portion 44 of the drum cartridge 10 can have a different color from the process-cartridge accommodating section 71 of the main casing 2 with a simple structure.

Further, when the process cartridge 3 is to be removed from the process-cartridge accommodating section 71 colored in black, the operator can easily identify the green-colored drum-cartridge grip 30 of the base frame 31A, facilitating reliable removal of the process cartridge 3 from the process-cartridge accommodating section 71.

Incidentally, while the base frame 31A is colored in green and the cover frame 31B is colored in black and the process-cartridge accommodating section 71 is colored in black as described above, the lock lever 32 is colored in blue, and the wire cleaner 28 is colored in green.

(13) According to the printer 1 of the embodiment, maintenance can be performed on the drum cartridge 10 reliably at the time of performing maintenance on the developing cartridge 11.

(14) Further, maintenance can also be reliably performed on the scorotron charger 14 of the drum cartridge 10 at the time of performing maintenance on the developing cartridge 11.

6. Variations of the Embodiments

Figure 19:
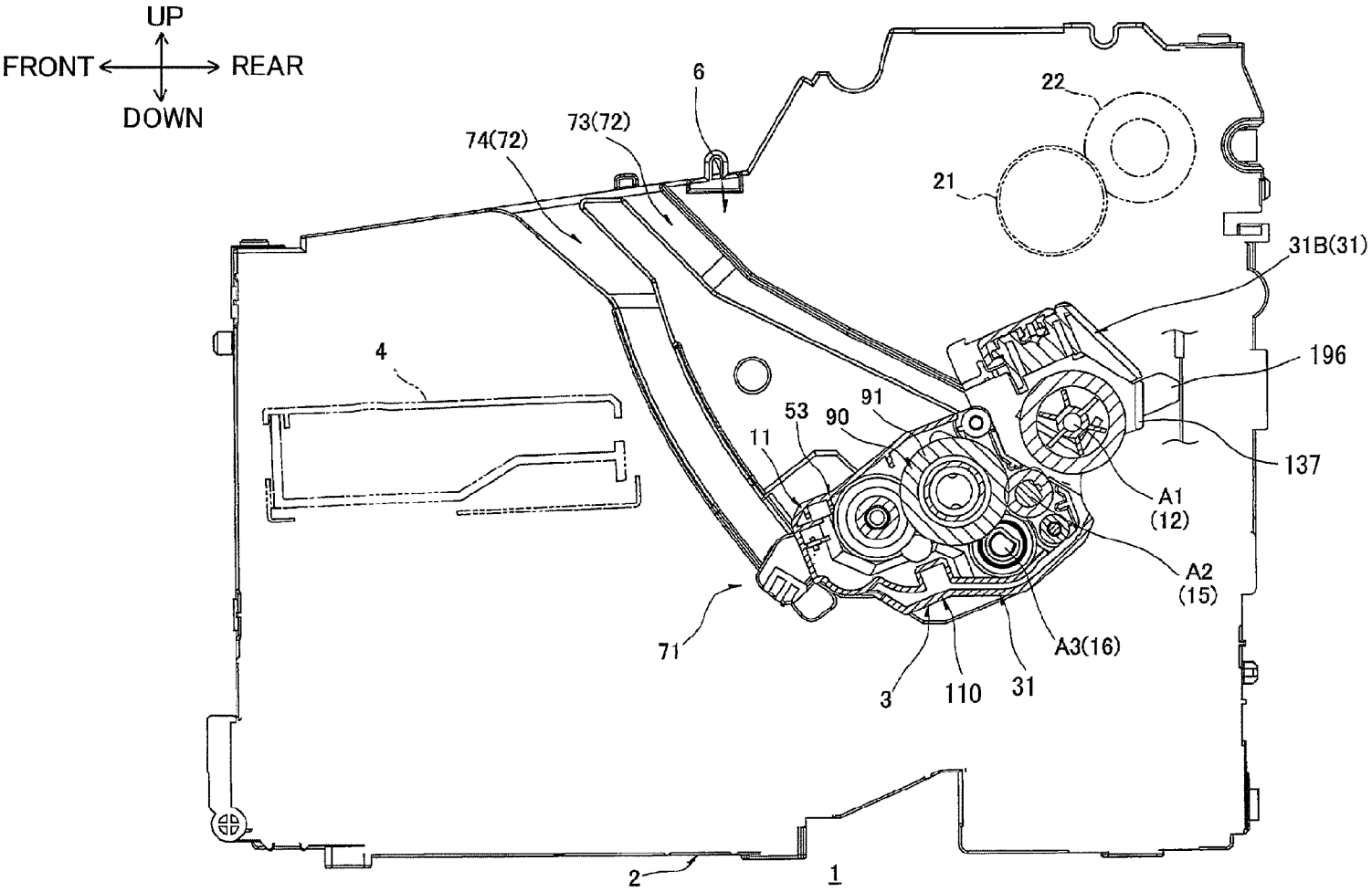
FIG. 19 is an explanatory cross-sectional view illustrating an internal structure of a printer according to a variation of the embodiment taken along a plane corresponding to an F-F plane shown in FIG. 10.

FIG. 19 shows a drum cartridge 110 according to a variation of the embodiment. In the depicted embodiment, the restricting ribs 96 are provided on the lower wall 35. Instead, in this variation, in place of the restricting ribs 96 provided on the lower wall 35, a restricting rib 196 is provided on a rear wall 137 of the drum cartridge 110 so as to protrude rearward therefrom.

In this case, when the process cartridge 3 is not compatible with the printer 1, the restricting rib 196 is configured to contact a rear wall constituting the process-cartridge accommodating section 71. This structure according to this variation can also restrict mounting of the incompatible process cartridge 3 on the process-cartridge accommodating section 71.

The printer 1 is described as an example of the image-forming device of the disclosure, but the disclosure is not limited to the above-described embodiment.

For example, the image-forming device of the disclosure may be configured as a color printer rather than the monochromic printer described above.

Examples of color printers include: a direct tandem color printer provided with a plurality of photosensitive bodies and a recording medium conveyer; and an intermediate-transfer-type tandem color printer provided with a plurality of photosensitive bodies, an intermediate transfer member and a transfer member.

Further, as an example of the photosensitive body, a photosensitive belt may also be used instead of the photosensitive drum 12 described above.

Further, as an example of the developer carrier, a developing sleeve, developing belt, brush roller, or other device may also be used in place of the developing roller 15 described above.

Further, instead of the supply roller 16 described above, a supply sleeve, a supply belt, or a brush roller, may be used as the supply member.

Further, in place of the agitator 20 described above, a device other than the agitator 20, such as an auger screw or a belt-shaped agitator, may be available.

Further, instead of the transfer roller 13 described above, the transfer member may be configured of a contact-type transfer member, such as a transfer belt, a transfer brush, a transfer blade, and a film-like transfer device, or a non-contact-type transfer member, such as a corotron-type transfer device.

Further, the charger may be configured of a non-contact type device, such as a corotron-type charger, and a charger provided with a sawtooth discharge member, or a contact-type charger such as a charging roller, instead of the scorotron charger 14.

Further, instead of the scanner unit 4, an exposing device other than the scanner unit 4, such as an LED unit may be available.

Further, the first cartridge may be configured as a toner box (toner cartridge) that stores toner without the developer carrier such as a developing roller.

In this case, the second cartridge may be configured as a cartridge possessing a developer carrier such as a developing roller, and an image carrier such as a photosensitive drum. Still alternatively, the second cartridge may be configured as a cartridge having two separable parts, one having a developer carrier such as a developing roller and another having an image carrier such as a photosensitive drum.

Further, in the embodiment, the lock lever 32 as an example of the restricting member is provided on the drum cartridge 10 and the restricted part 59 is provided on the developing cartridge 11. However, alternatively, the restricting member may be provided on the developing cartridge 11, while the restricted part may be provided on the drum cartridge 10.

Further, the image-forming device of the disclosure may be configured as a multifunction device provided with an image scanner.

While the description has been made in detail with reference to the embodiment thereof, it would be apparent to those skilled in the art that various changes and modifications may be made therein without departing from the spirit and scope of the above-described embodiment.

What is claimed is:

1. An image-forming device comprising:

a cartridge comprising:

a first cartridge configured to store developer therein; and a second cartridge configured to detachably accommodate the first cartridge; and a main body including a cartridge receiving section configured to receive the cartridge, the first cartridge being attachable to the second cartridge in a state where the second cartridge, without the first cartridge, is mounted in the cartridge receiving section, the first cartridge being configured to be restricted from being detached from the second cartridge in a state where the first cartridge and the second cartridge are both mounted in the cartridge receiving section, wherein the second cartridge comprises a lock lever configured to pivot between a restricting position and a non-restricting position, the lock lever at the restricting position restricting detachment of the first cartridge from the second cartridge, the lock lever at the non-restricting position allowing detachment of the first cartridge from the second cartridge, the lock lever being resiliently deformable to allow attachment of the first cartridge to the second cartridge when the second cartridge is already mounted in the cartridge receiving section, wherein the first cartridge comprises a protrusion configured to be restricted by the lock lever and to oppose the lock lever, the lock lever opposing the protrusion restricting the detachment of the first cartridge from the second cartridge, and wherein the main body further comprises an opposing member provided in the cartridge receiving section and configured to fix the lock lever in the restricting position, the opposing member being configured to contact the lock lever to restrict the lock lever from pivoting from the restricting position to the non-restricting position when the second cartridge is mounted in the cartridge receiving section.

2. The image-forming device as claimed in claim 1, wherein the first cartridge is configured to be removed from the cartridge receiving section together with the second cartridge in a state where the first cartridge and the second cartridge are both mounted in the cartridge receiving section.

3. The image-forming device as claimed in claim 1, wherein the lock lever at the restricting position is configured to resiliently deform to allow attachment of the first cartridge to the second cartridge and to restrict detachment of the first cartridge from the second cartridge.

4. The image-forming device as claimed in claim 1, wherein the first cartridge is configured to be attached to the second cartridge in an attaching direction, wherein the lock lever comprises a first surface and a second surface, the first surface being oriented generally in the attaching direction and the second surface being oriented in a direction intersecting the attaching direction when the lock lever is in the restricting position, wherein the protrusion comprises a third surface extending along the first surface and a fourth surface extending along the second surface, and wherein the third surface is configured to make contact with the first surface during attachment of the first cartridge to the second cartridge that has been mounted in the cartridge receiving section, the fourth surface facing the second surface upon completion of the attachment of the first cartridge to the second cartridge when the second cartridge is already mounted in the cartridge receiving section.

5. The image-forming device as claimed in claim 4, wherein the lock lever is configured to pivot between the restricting position and the non-restricting position about a pivot fulcrum, the lock lever further comprising an abutting part configured to abut on the opposing member, the abutting part being positioned farther away from the pivot fulcrum than the first surface is from the pivot fulcrum.

6. The image-forming device as claimed in claim 1, wherein the cartridge is elongated in a longitudinal direction, wherein the first cartridge comprises a first grip configured to be gripped by an operator, and wherein the second cartridge comprises a second grip configured to be gripped by the operator, the first grip and the second grip being provided at positions different from each other in the longitudinal direction.

7. The image-forming device as claimed in claim 1, wherein the first cartridge is configured to be attached to the second cartridge when the second cartridge is already mounted in the cartridge receiving section in an attaching direction, and wherein the cartridge is configured to be mounted in the cartridge receiving section generally in the attaching direction.

8. The image-forming device as claimed in claim 7, wherein the cartridge is configured to be pivoted in a pivoting direction to be mounted in the cartridge receiving section, and wherein the first cartridge is configured to be pivoted generally in the pivoting direction to be attached to the second cartridge when the second cartridge is already mounted in the cartridge receiving section.

9. The image-forming device as claimed in claim 7, wherein the main body comprises a guide part configured to guide mounting of the cartridge relative to the cartridge receiving section.

10. The image-forming device as claimed in claim 1, wherein the main body is formed with a device opening through which the cartridge receiving section can be exposed, and wherein the second cartridge comprises a first-cartridge attachment portion configured to receive the first cartridge therein, the first-cartridge attachment portion being exposed through the device opening in a state where the second cartridge alone is mounted in the cartridge receiving section.

11. The image-forming device as claimed in claim 10, wherein the cartridge receiving section and the first-cartridge attachment portion are colored in colors different from each other.

12. The image-forming device as claimed in claim 10, wherein the second cartridge comprises:

a first frame provided with the first-cartridge attachment portion and colored in a first color; and a second frame assembled to the first frame to expose the first-cartridge attachment portion and colored in a second color different from the first color.

13. The image-forming device as claimed in claim 1, wherein the first cartridge comprises a developer carrier configured to carry the developer, and wherein the second cartridge comprises a photosensitive body configured to contact the developing carrier.

14. The image-forming device as claimed in claim 13, wherein the second cartridge further comprises a charger configured to charge the photosensitive body.

* * * * *